US005251685A

United States Patent [19]

Praeg

[11] Patent Number: 5,251,685

[45] Date of Patent: Oct. 12, 1993

[54] APPARATUS AND METHOD FOR SIDEWALL CONTAINMENT OF MOLTEN METAL WITH HORIZONTAL ALTERNATING MAGNETIC FIELDS

[75] Inventor: Walter F. Praeg, Palos Park, Ill.

[73] Assignee: Inland Steel Company, Chicago, Ill.

[21] Appl. No.: 926,166

[22] Filed: Aug. 5, 1992

[51] Int. Cl.[5] ..... B22D 27/02; B22D 11/06

[52] U.S. Cl. ..... 164/467; 164/503; 164/480; 164/428

[58] Field of Search ..... 164/428, 480, 503, 467

[56] References Cited

U.S. PATENT DOCUMENTS

| | | | |
|---|---|---|---|
| 4,020,890 | 5/1977 | Olsson | 164/49 |
| 4,762,653 | 8/1988 | Senillou et al. | 264/22 |
| 4,776,980 | 10/1988 | Ruffini | 252/513 |
| 4,936,374 | 6/1990 | Praeg | 164/503 |
| 4,974,661 | 12/1990 | Lari et al. | 164/503 |
| 4,986,339 | 1/1991 | Miyazawa | 164/466 |
| 5,197,534 | 3/1993 | Gerber et al. | 164/480 |

FOREIGN PATENT DOCUMENTS

| | | | |
|---|---|---|---|
| 60-106651 | 6/1985 | Japan | 11/10 |
| 62-104653 | 5/1987 | Japan | 11/6 |

OTHER PUBLICATIONS

J. S. LaMonte and M. R. Black, "How flux field concentrators improve inductor efficiency," *Heat Treating*, Jun., 1989 pp. 30–31.

"Induction Hardening with a Flux Field Concentrator," *Electrical Power Research Institute Technical Application*, vol. 1, No. 11, 1987.

"Guarantee only from Fluxtrol," an advertisement mailed by Fluxtrol of unknown date.

*Primary Examiner*—Kuang Y. Lin

*Attorney, Agent, or Firm*—Marshall, O'Toole, Gerstein, Murray & Borun

[57] ABSTRACT

Molten metal, in the gap between two counter-rotating rolls of a continuous strip-casting apparatus, is prevented from leaking out of an open side of the gap by a magnetic confining apparatus which produces a horizontal magnetic field extending through the open side of the gap. The apparatus includes structure for confining the magnetic field substantially to the open side of the gap and for preventing dissipation of the magnetic field away from the open side of the gap.

65 Claims, 20 Drawing Sheets

APPARATUS AND METHOD FOR SIDEWALL CONTAINMENT OF MOLTEN METAL WITH HORIZONTAL ALTERNATING MAGNETIC FIELDS

FIELD OF THE INVENTION

The present invention relates generally to apparatuses and methods for electromagnetically confining molten metal and more particularly to an apparatus and method for preventing the escape of molten metal through the open side of a vertically extending gap between two horizontally spaced members and within which the molten metal is located.

BACKGROUND OF THE INVENTION AND PRIOR ART

An example of an environment in which the present invention is intended to operate is an arrangement for continuously casting molten metal directly into strip, e.g., steel strip. Such an apparatus typically comprises a pair of horizontally spaced rolls mounted for rotation in opposite rotational senses about respective horizontal axes. The two rolls define a horizontally disposed, vertically extending gap therebetween for receiving the molten metal. The gap defined by the rolls tapers in a downward direction. The rolls are cooled, and in turn cool the molten metal as the molten metal descends through the gap.

The gap has horizontally spaced, open opposite sides adjacent the ends of the two rolls. The molten metal is unconfined by the rolls at the open ends of the gap. To prevent molten metal from escaping outwardly through the open ends of the gap, mechanical dams or seals have been employed.

Mechanical dams have drawbacks because the dam is in physical contact with both the rotating rolls and the molten metal. As a result, the dam is subject to wear, leaking and breakage and can cause freezing and large thermal gradients in the molten metal. Moreover, contact between the mechanical dam and the solidifying metal can cause irregularities along the edges of metal strip cast in this manner, thereby offsetting the advantages of continuous casting over the conventional method of rolling metal strip from a thicker, solid entity.

The advantages obtained from the continuous casting of metal strip, and the disadvantages arising from the use of mechanical dams or seals are described in more detail in Praeg U.S. Pat. No. 4,936,374 and in Lari, et al. U.S. Pat. No. 4,974,661, and the disclosures of each of these patents are incorporated herein by reference.

To overcome the disadvantages inherent in the employment of mechanical dams or seals, efforts have been made to contain the molten metal at the open end of the gap between the rolls by employing an electromagnet having a core encircled by a conductive coil through which an alternating electric current flows and having a pair of magnet poles located adjacent the open end of the gap. The magnet is energized by the flow of alternating current through the coil, and the magnet generates an alternating or time-varying magnetic field, extending across the open end of the gap, between the poles of the magnet. The magnetic field can be either horizontally disposed or vertically disposed, depending upon the disposition of the poles of the magnet. Examples of magnets which produce a horizontal field are described in the aforementioned Praeg U.S. Pat. No. 4,936,374; and examples of magnets which produce a vertical magnetic field are described in the aforementioned Lari, et al. U.S. Pat. No. 4,974,661.

The alternating magnetic field induces eddy currents in the molten metal adjacent the open end of the gap, creating a repulsive force which urges the molten metal away from the magnetic field generated by the magnet and thus away from the open end of the gap.

The static pressure force urging the molten metal outwardly through the open end of the gap between the rolls increases with increased depth of the molten metal, and the magnetic pressure exerted by the alternating magnetic field must be sufficient to counter the maximum outward pressure exerted on the molten metal. A more detailed discussion of the considerations described in the preceding sentence and of the various parameters involved in those considerations are contained in the aforementioned Praeg and Lari, et al. U.S. Patents.

With horizontally disposed electromagnetic fields, the prior art achieves magnetic confinement of the sidewall of molten metal at the open end of the gap by providing a low reluctance flux path near the end of each roll (the rim portion of the roll). The apparatus of the prior art comprises an electromagnet for generating an alternating magnetic field that is applied, via the low reluctance rim portions of the rolls, to the sidewall of the molten metal contained by the rolls. For efficient application of the magnetic field, each magnet pole must extend axially, relative to the rolls, very close to the end of a respective roll to be next to the low reluctance rim portion of the roll and separated from this rim portion by only a small radial air gap. For efficient operation, the low reluctance flux path in the rim portion of a roll usually is formed from highly permeable magnetic material.

The prior art electromagnetic confinement methods and apparatuses have several drawbacks:

(1) The peak flux density obtainable is limited by saturation of the highly permeable magnetic material in the rim portions of the rolls, or, in applications where the rim portions do not contain permeable magnetic material, by saturation of the poles of the electromagnet. The state of the art, utilizing thin laminations of grain-oriented silicon steel, limits the horizontal field to approximately 18 kG (Kilogauss). This in turn limits the height of the molten metal pool that can be contained electromagnetically. In addition, at these high flux densities, the heat losses in both the roll laminations, and in the laminations of the magnetic poles near the nip, become excessive; for 0.002 inch (0.051 mm) laminations operating at 18 kG and 3 kHz (Kilo-Hertz), losses are about 300 Watts per pound (660.8 W/kg);

(2) The low reluctance rim portions of the rolls are difficult to cool, resulting in a more complicated and expensive roll design;

(3) The pool of molten metal causes thermal expansion of the rolls which in turn causes stress and strain and/or spatial changes in the low reluctance flux path of the roll rims, altering their reluctance and with it, the performance of the electromagnetic containment; and (4) In case of a disturbance in the molten metal feed system, or a power failure to the electromagnet, the molten metal (at $\approx 1540°$ C., for steel) will contact the low reluctance rim portion, necessitating a rim design resistant to the high temperature of the molten metal.

A high temperature design for the roll rims impairs its low magnetic reluctance, and, most likely increases its cost of manufacture.

Another expedient for horizontal containment of molten metal at the open end of a gap between a pair of members, e.g., rolls, is to locate, adjacent the open end of the gap, a coil through which an alternating current flows. This causes the coil to generate a magnetic field which induces eddy currents in the molten metal adjacent the open end of the gap resulting in a repulsive force similar to that described above in connection with the magnetic field generated by an electromagnet. Embodiments of this type of expedient are described in Olsson U.S. Pat. No. 4,020,890, and the disclosure therein is incorporated herein by reference.

SUMMARY OF THE INVENTION

The drawbacks and deficiencies of the prior art expedients described above are eliminated by an apparatus and method in accordance with the present invention.

A magnetic confining method and apparatus in accordance with the present invention generates, adjacent the open side of the roller gap, a shaped, horizontal magnetic field which extends through the open side of the gap to the molten metal in the gap, without the need for low reluctance flux paths in the roller edges. The magnetic fields generated in accordance with the present invention are not limited by saturation of highly permeable magnet laminations and, therefore, can be larger than the magnetic fields achieved in accordance with the prior art.

The horizontal magnetic field is generated by a coil surrounding a magnetic core to provide a pair of magnet poles located adjacent the open side of the gap, with a surface portion of the magnet poles disposed near the open side of the gap. Typically, alternating current is conducted through the coil to generate the horizontal magnetic field which extends from the facing surfaces of the magnet poles, through the open side of the gap, to the molten metal. The magnet poles are located sufficiently close to the open side of the gap to contain the molten metal within the gap. An inner, non-magnetic shield means is disposed between the magnet poles adjacent to the open side of the gap, and shaped to confine the horizontal magnetic field through the gap to the molten metal. The shield may be insulated from the core and the poles, or it may be in electrical contact to serve as a heat sink.

The apparatus and method of the present invention concentrate or shape the magnetic field in a direction generally restricted toward the open side of the gap and the molten metal there, without substantial dissipation of the magnetic field in a direction away from the open side of the gap, employing, shaped inner and outer shields surrounding the coil. The direction of disposition of the magnet poles, facing the open side of the roll gap, together with an inner shield formed from a non-magnetic conductor, such as copper or a copper base alloy, and shaped to force the magnetic field into the sidewall of the molten metal, provide sufficient magnetic force to prevent molten metal from leaking out of the open side of the roll gap.

An outer shield, also formed from a non-magnetic conductor, such as copper or a copper base alloy, contains the leakage of magnetic fields away from the gap; the outer shield can be shaped to direct the flux leaving the magnet poles in the direction of the open side of the roll gap, toward the molten metal.

In one embodiment, shaped, horizontal, alternating magnetic containment fields interact with the rim and sidewall of the rolls to produce the desired electromagnetic containment of the pool of molten metal between the surfaces of a pair of counter-rotating rolls, as the molten metal is cast into a vertical sheet. The frequency of the alternating magnetic field is chosen to optimize field penetration into the sidewall of the molten pool of metal and the rim and sidewall of the rolls and to minimize eddy current heating of these roll rims and sidewalls.

The inner and outer non-magnetic conductor shields are configured to conform to the tapered shape of the open side of the roll gap so as to increase the magnetic pressure against the molten metal, in accordance with increasing static (i.e., depth) and dynamic (e.g., effects due to fluid flow) pressure of the molten metal in the gap. The magnetic field shaping can be accomplished exclusively by the electromagnetic assembly without the need to modify the roll rims, e.g., with ferromagnetic inserts in the roll rims, to provide a low reluctance flux path through the roll rims, although the roll rims may be bevelled advantageously to enhance the magnetic field near the molten metal sidewall.

Other features and advantages are inherent in the method and apparatus of the present invention or will become apparent to those skilled in the art from the following detailed description taken in conjunction with the accompanying drawings.

DETAILED DESCRIPTION OF THE PREFERRED EMBODIMENTS

Figure 1:
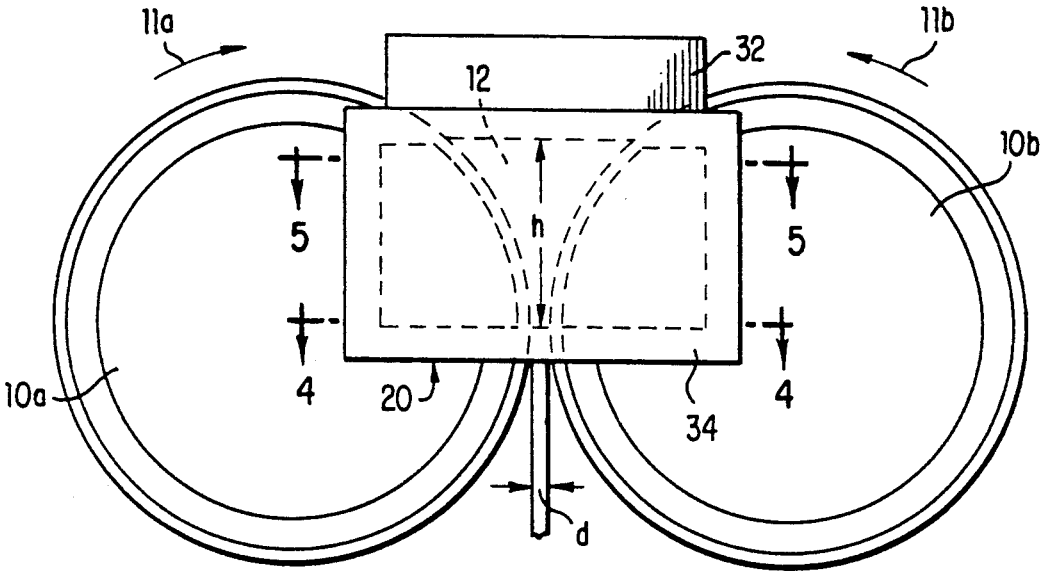
FIG. 1 is an end view showing an embodiment of an apparatus in accordance with the present invention, associated with a pair of rolls of a continuous strip caster.
Figure 2:
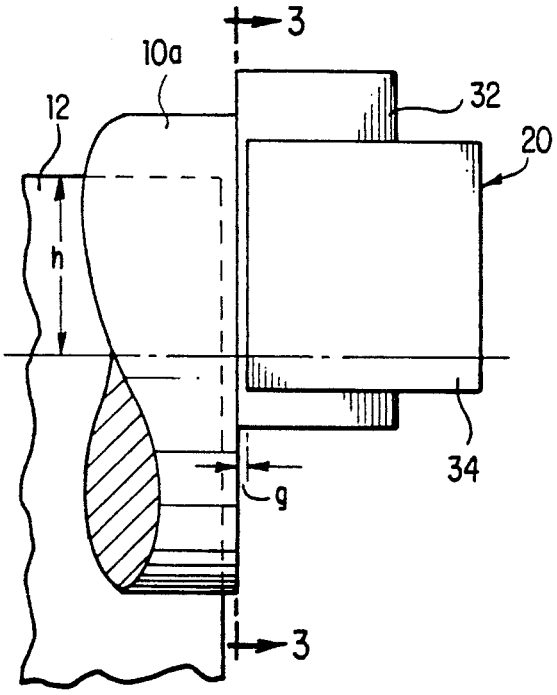
FIG. 2 is a side view of the apparatus and rolls of FIG. 1.

Referring to the drawings, and initially to FIGS. 1-5, there is shown an embodiment of the magnetic confinement apparatus of the present invention associated with a pair of rolls of a continuous strip caster. It should be understood that while this specification will describe molten metal confinement at one end of a pair of rolls, there is confinement of molten metal between a pair of counter-rotating rolls at both ends of the pair of rolls.

As shown in FIG. 1, a pair of rolls 10*a* and 10*b* (referred to collectively as rolls 10) are parallel and adjacent to each other and have axes which lie in a horizontal plane so that molten metal 12, in a pool of height h, can be contained between the rolls 10, above a point where the rolls are closest together (the nip). Rolls 10 are separated by a gap having a dimension d at the nip. Counter rotation of rolls 10*a* and 10*b* (in the direction shown by the arrows 11*a* and 11*b*), and gravity, force molten metal 12 to flow downwardly and to solidify by the time it leaves the gap d at the nip between rolls 10. Rolls 10 are made of a material having a suitable thermal conductivity, for example, copper or a copper base alloy, stainless steel, and the like, and are water cooled internally.

Figure 3:
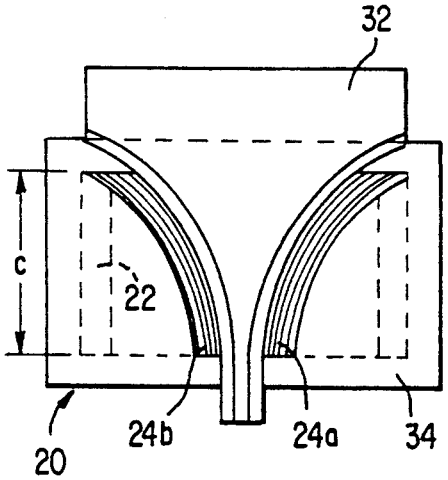
FIG. 3 is a front view of the apparatus taken along the line 3—3 of FIG. 2.
Figure 4:
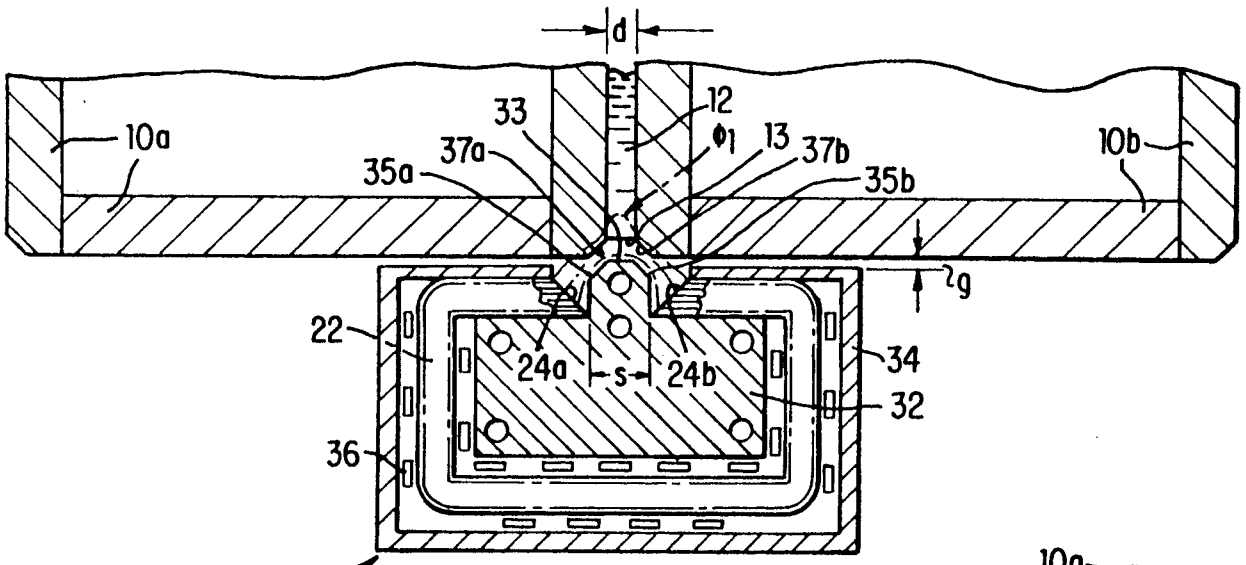
FIG. 4 is a sectional view of the apparatus taken along the line 4—4 of FIG. 1.
Figure 5:
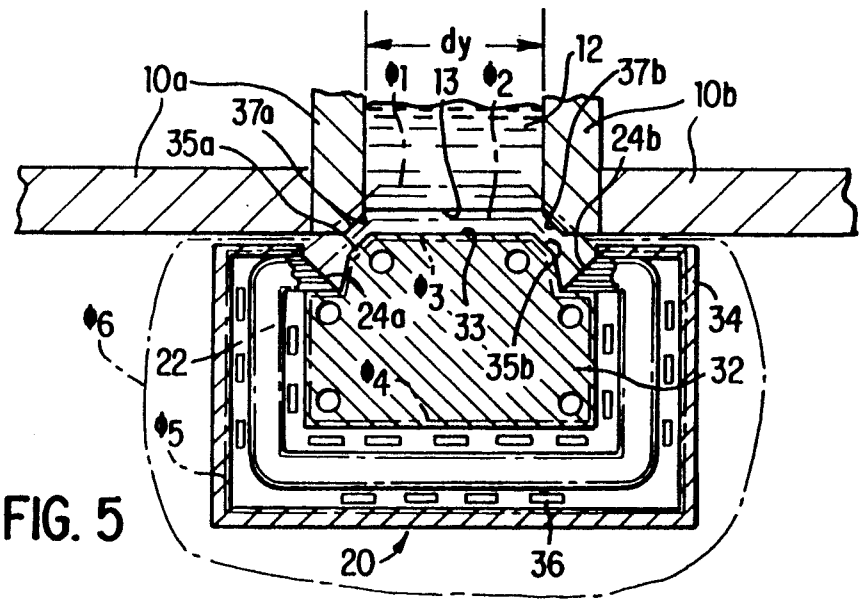
FIG. 5 is a sectional view of the apparatus taken along the line 5—5 of FIG. 1.

Referring now specifically to FIGS. 3, 4 and 5, magnet 20 includes a core 22 having pole faces 24*a* and 24*b*. Turns of a coil 36 wind around magnet core 22 and carry an alternating electric current thereby magnetizing magnet 20 and inducing a magnetic field, shown schematically as magnetic flux in dotted lines, in FIGS. 4 and 5, between pole faces 24*a* and 24*b*.

In this embodiment, core 22 may be made from any one of tape-wound ferromagnetic steel, for example, silicon steel, grain-oriented silicon steel, amorphous alloys, or the like. For the core 22 shown in FIGS. 3, 4 and 5, the tape width is equal to the core height, having dimension c. The tape thickness, for example, 0.002 inch (0.051 mm), is chosen to reduce core loss. The pole faces 24*a* and 24*b* are machined to suit the rolls 10 of the casting apparatus so that the electromagnetic field is directed toward the gap, having dimension d, between the rolls.

Magnet 20 is stationary and separated from rolls 10 by a space width, g (FIG. 4), large enough to allow free rotation and thermal expansion of rolls 10. In some cases, a layer of high temperature ceramic may be inserted between the molten metal and magnet 20 as a thermal barrier.

Magnetic flux leaves and enters pole faces 24*a* and 24*b* in a direction perpendicular to magnet pole faces 24*a* and 24*b*. Some of the flux bridges the space between magnet 20 and the sides of rolls 10 and penetrates the rolls and the molten metal, as shown schematically in dotted lines in FIG. 4. Due to eddy currents created by the magnetic flux in rolls 10, and in molten metal 12, the field decays exponentially in proportion to the distance from these metal surfaces. The interaction of these eddy currents (flowing in essentially vertical loops) with the horizontal magnetic field that produced them, results in an electromagnetic force that balances the forces which urge the molten metal pool axially outward at the roll gap end. As a result, molten metal 12 is contained near the end of the gap between rolls 10 and magnet 20.

An inner eddy current shield 32, and an outer eddy current shield 34, enclose core 22 and coil turns 36 except near the pole faces 24*a* and 24*b*. Shields 32 and 34 are electrically connected without forming an electrically shorted turn around magnetic core 22 and coil turns 36. Shields 32 and 34 concentrate the magnetic flux between pole surfaces 24*a* and 24*b* and reduce leakage of flux around the outside of core 22. Surface 33 of inner shield 32 is disposed adjacent to molten metal sidewall 13. The shape of the adjacent inner shield surface 33, and its degree of separation from the roll rims and molten metal 12 influence the overall flux distribution.

When an alternating magnetic field of amplitude $B_o$, that changes with time, t, is applied parallel to a conducting sheet with resistivity $\rho$, the magnetic field, B, and the eddy current density, J, in the conducting sheet are attenuated and phase shifted as they penetrate the sheet surface. These changes depend on the distance of the magnetic field from the conducting surface, x, upon the permeability of the conducting sheet, $\mu$, and upon the frequency, f, of the alternating field, as shown in equations 1 and 2:

$$B_x = B_o \epsilon^{-x/\delta} \cos(\omega t - x/\delta) \quad (1)$$

$$J_x = (\omega/\mu\rho)^{\frac{1}{2}} B_o \epsilon^{-x/\delta} \cos(\omega t + \pi/4 - x/\delta) \quad (2)$$

where $\epsilon = 2.75$ $\omega = 2\pi f$ $\delta = (\rho/\mu\pi f)^{\frac{1}{2}}$ = skin depth As shown by equations (1) and (2), the magnetic field and eddy currents penetrate the sidewalls of the rolls and of the molten metal only to a few skin depths; e.g., their values are reduced to 10% of the surface value at depths $x = 2.3\delta$. It can be shown that the total exponentially decaying field in a conductor is equivalent to an imaginary, uniformly distributed field confined to the conductor surface to a depth $x = \delta$.

As illustrated by the dotted flux lines in FIGS. 4 and 5, only flux $\phi_1$, which penetrates the molten metal, generates containment forces. Flux $\phi_2$ in the air space between adjacent inner shield surface 33 and surface 13 of the molten sidewall, as well as fluxes $\phi_3$, $\phi_4$, and $\phi_5$ in the walls of the shields and flux $\phi_6$ in the air surrounding magnet 20, do not interact with the molten metal for containment.

With reference to FIGS. 4 and 5, the ratio of containment flux $\phi_1$ to the total flux $$\Psi = \sum_{1}^{6} \phi_n,$$

is improved, especially near the roll nip, by manufacturing the roll rims and adjacent inner shield surface 33 to include parallel beveled surfaces 37 and 35, respectively, and by providing complementary shaped magnet pole surfaces 24*a* and 24*b* that are disposed essentially perpendicular to the planes of bevelled surfaces 35 and 37. In this embodiment of the invention, FIGS. 4 and 5 separately show the design of magnet 20 at two molten metal levels, each including angled pole faces 24*a* and 24*b* for use with beveled, complementary shaped roll rims.

Figure 7:
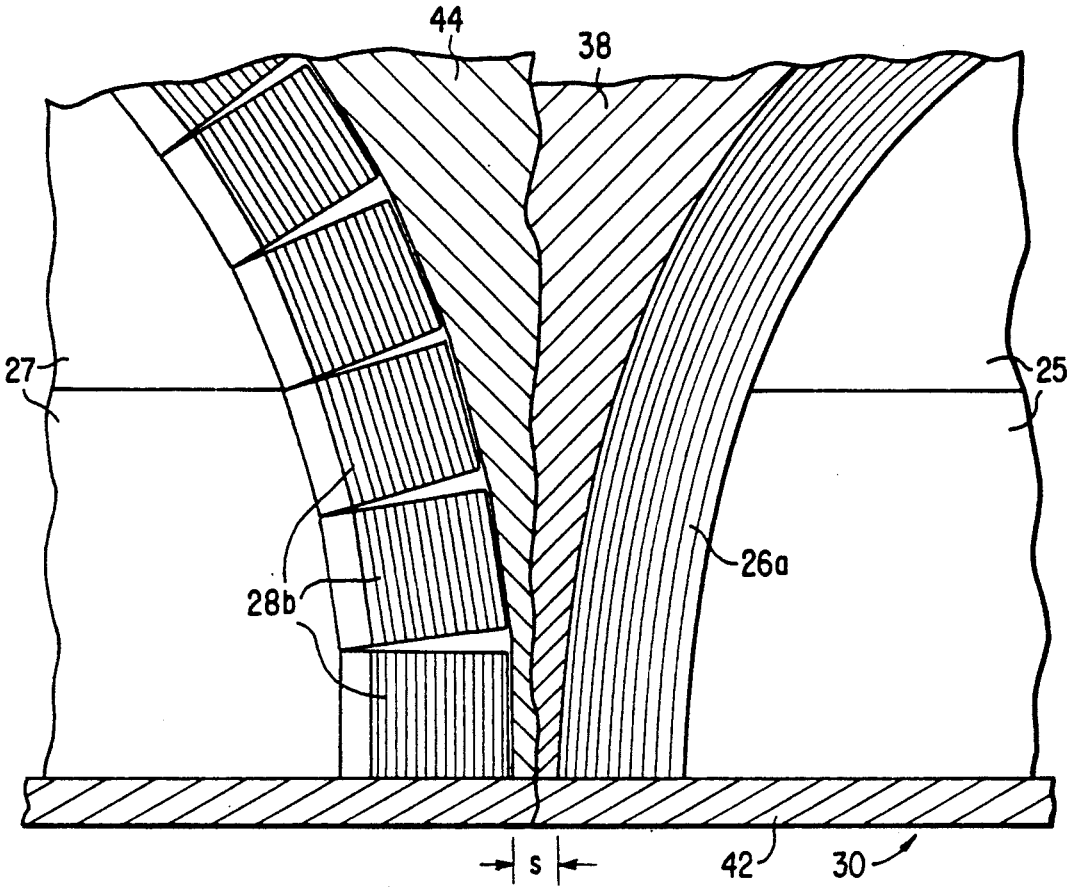
FIG. 7 is an enlarged sectional view taken along the line 713 7 of FIG. 6.
Figure 6:
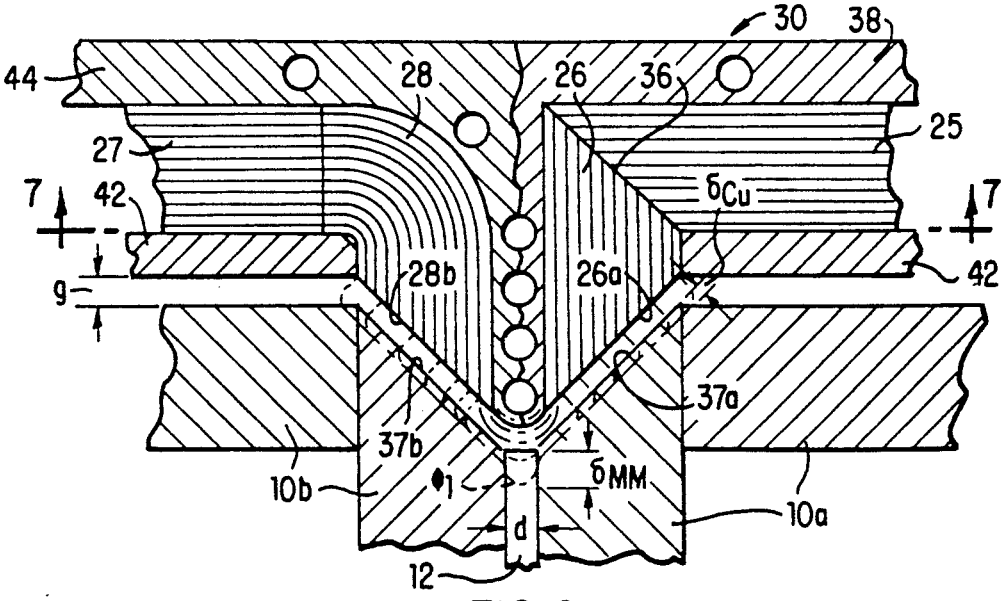
FIG. 6 is an enlarged, horizontal, sectional view of the apparatus of the present invention, partially broken away and showing the directional disposition of magnet poles and of complementary shaped, bevelled roll rims, in accordance with one embodiment of the present invention.
Figure 10A:
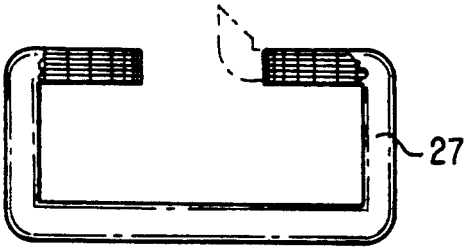
FIGS. 10*a* and 10*b* are top and side views, respectively, showing the magnetic core portion of the apparatus of FIG. 6.
Figure 10B:
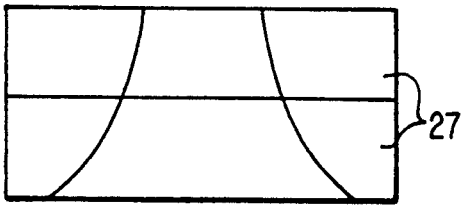

In one embodiment of the present invention illustrated on the right half of FIGS. 6 and 7, magnet core 25 is cut at an angle of 45° to form a butt-joint 36 with pole 26. Pole face 26*a* is parallel to the surface 37 of roll rim 10*a*; the separation of face 26*a* and surface 37 is a little larger than the thermal expansion of the roll 10.

Figure 8B:
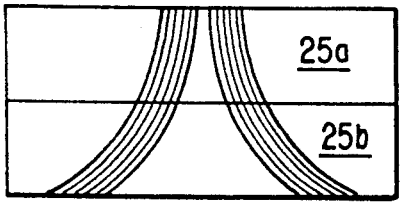
FIGS. 8*a* and 8*b* are top and side plan views, respectively, of the magnetic core of FIG. 6.
Figure 8A:
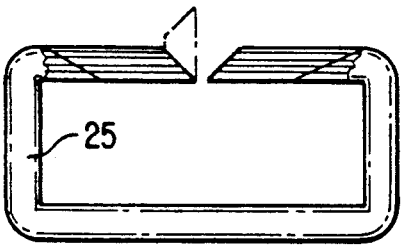
Figure 11A:
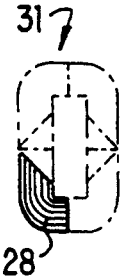
FIGS. 11*a* and 11*b* are top and side views, respectively, showing details of manufacture of the magnet poles of the apparatus of FIG. 6.
Figure 11B:
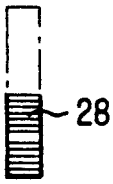

FIGS. 8 and 9 illustrate, on a smaller scale, how core 25 and poles 26 are machined from tape-wound cores. FIG. 8*a* is a top view, and FIG. 8*b* is a front view of a core 25 which is made from two sections 25*a* and 25*b* stacked on top of each other.

Figure 9A:
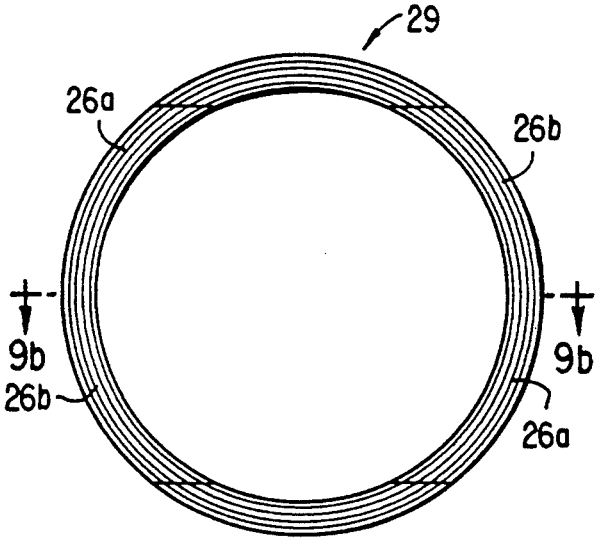
FIG. 9*a* is a plan view of a toroid-shaped magnetic core from which are cut poles 26*a* and 26*b* of FIGS. 6 and 7 in accordance with one embodiment of the present invention.
Figure 9B:
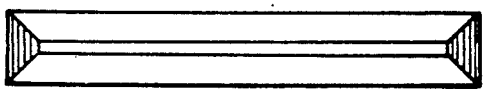
FIG. 9*b* is a sectional view taken along line 9*b*—9*b* of FIG. 9*a;*

In accordance with another embodiment of the present invention, as shown in FIGS. 9*a* and 9*b*, poles 26 are manufactured by cutting them from a machined, tape-wound, toroidal core, generally designated by reference numeral 29. As shown on the right side of FIGS. 6 and 7, an inner shield 38 and an outer shield 42 enclose the core 25 and poles 26, except for an air gap that prevents these shields from being a shorted turn for the core flux. The inner and outer shields 38 and 42 force the core flux into the pole surface 26*a*. The excitation coil, not shown in FIGS. 6 and 7, is wound over these shields 38 and 42, as will be described in more detail hereinafter.

On the left side of FIGS. 6 and 7, there is shown another embodiment of the magnetic containment apparatus of the present invention wherein a magnet core 27 is cut at an angle of 90° for butt-joining a number of pole portions 28 (FIG. 11) having pole surfaces 28*b* disposed parallel to bevelled surface 37 of roll 10*b*. FIGS. 10*a*, 10*b*, 11*a* and 11*b* show, on a smaller scale, the manufacture of core 27 and pole portions 28 machined from tape-wound cores, generally designated by reference numeral 31. Again an inner shield, 44, and the outer shield, 42, contain and direct the core flux, as shown on the left side of FIG. 6.

A comparison of FIG. 4 with FIG. 6 illustrates that for identical roller diameters the magnetic circuit of FIG. 6 has a better ratio of containment flux $\phi_1$ to total flux $\Psi$. As shown in FIG. 6, more of the flux of the pole surfaces penetrates the roll rims 10*a* and 10*b*, and subsequently the molten metal 12, than is the case in the configuration shown in FIG. 4.

Figure 12:
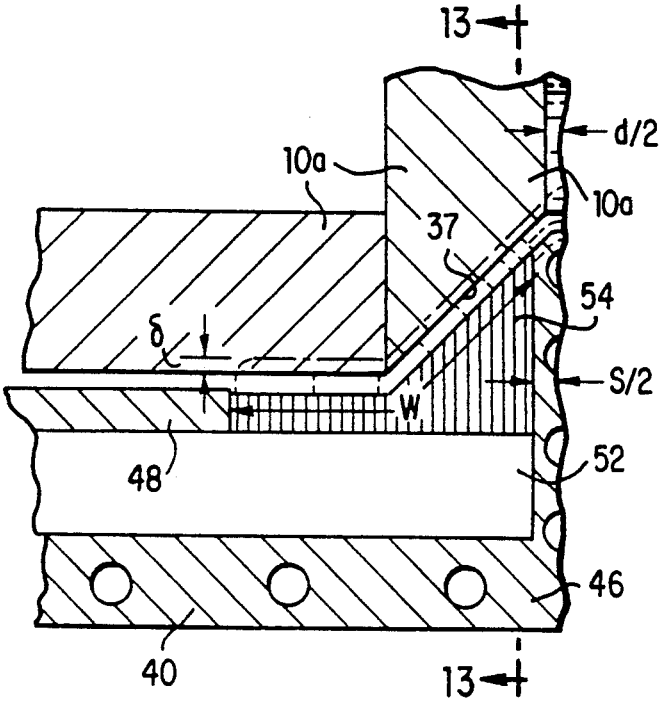
FIG. 12 is a top view, partially broken-away, showing another embodiment of complementary shaped magnet poles and roll rims of the present invention.
Figure 13:
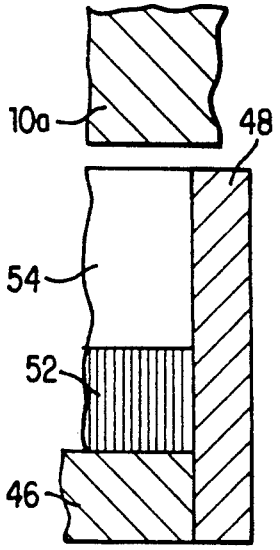
FIG. 13 is a sectional view taken along the line 13—13 of FIG. 12.

FIGS. 12 and 13 depict another variation of a magnet 40, useful in accordance with the principles of the present invention. In this embodiment, the width, w, of the surface of pole 54 has been made larger than the beveled rim 37 of roll 10*a*. Pole 54 extends along the roll sidewall, which is disposed perpendicular to the roll axis.

The enlarged pole 54 enlarges the roll surface that collects flux over its skin depth $\delta$, thereby increasing the flux density in the molten metal. By varying the width, w, of pole 54, as the distance from the pool bottom (nip) varies, the flux density in the sidewall of the molten metal and in the rolls 10 can be controlled. Variations in the width w of pole 54 permit control of the sidewall containment forces and of the power dissipation per unit area, both of which are proportional to the square of the flux density, to suit any given application.

In the embodiment shown in FIG. 12, magnet pole 54 may be cut from a machined, tape-wound toroid using a technique as described for pole 26 in FIG. 6. Magnet core 52 has a shape similar to the core of FIGS. 10*a* and 10*b* with the exception that the core 52 is made either from stamped laminations or from straight sections similar to the core section designated by reference numeral 99 in FIG. 23. The core laminations in FIG. 12 are at a right angle as compared with the build-up of laminations of the tape-wound cores shown in FIGS. 3, 4, 6, 8 and 10; this facilitates penetration of the extension of pole 54 by some of the flux from core 52. Eddy current shields 46 and 48 confine and direct the core flux and act as heat sinks.

Figure 14:
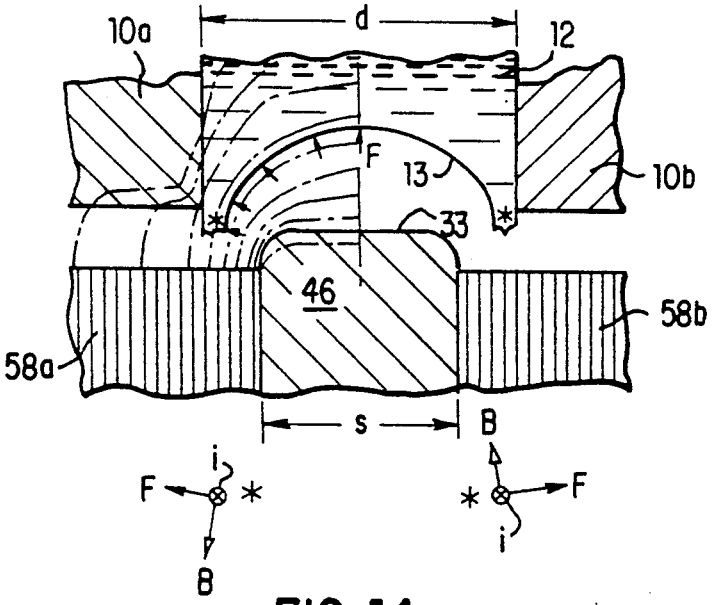
FIG. 14 is a horizontal, sectional view, partially broken-away, showing the molten metal 12 and magnetic field under certain operating conditions.
Figure 16:
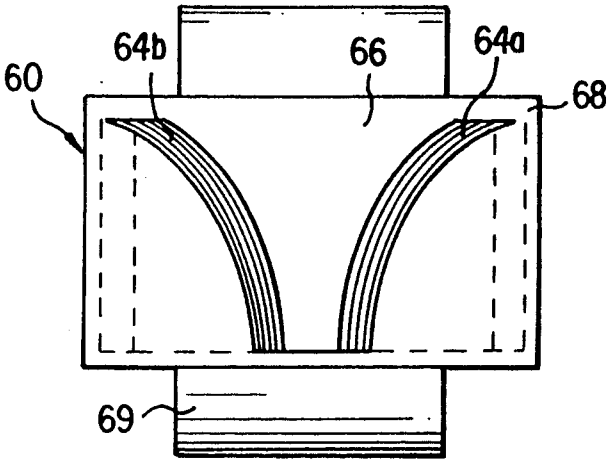
FIG. 16 is a front view taken along the line 16—16 of FIG. 15.
Figure 15:
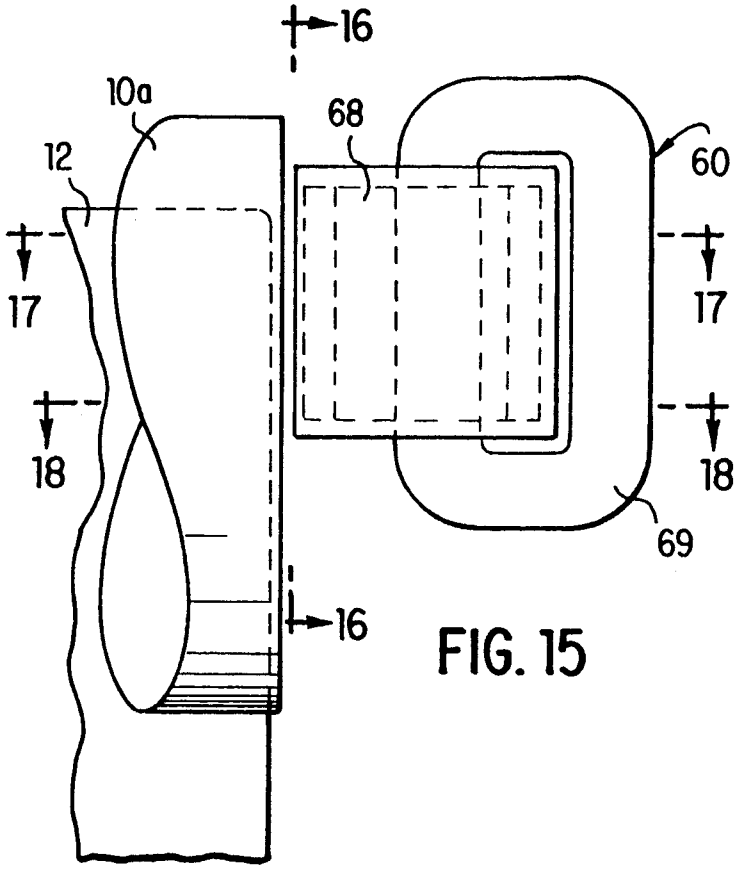
FIG. 15 is a side view, partially broken-away, showing another embodiment of an apparatus in accordance with the present invention, associated with rolls of a continuous strip caster.

For molten metal sidewall containment, the major component of the horizontal magnetic field, B, should be in a direction perpendicular to the roll axes. This will not be the case near the edge of the roll unless the pole separation S is greater than the distance d between the rolls. As shown in FIG. 14, where S is less than d, the major component of field B between poles 58*a* and 58*b* near the roll edges is parallel to the roll axes. Consequently, the magnetic force F near these edges is mainly in a direction perpendicular to the roll axes; and the molten metal will not be contained near the roll edges. The direction of the field B, eddy current i, and force F, are shown for the sidewall location marked by asterisks in FIG. 14.

Figure 19:
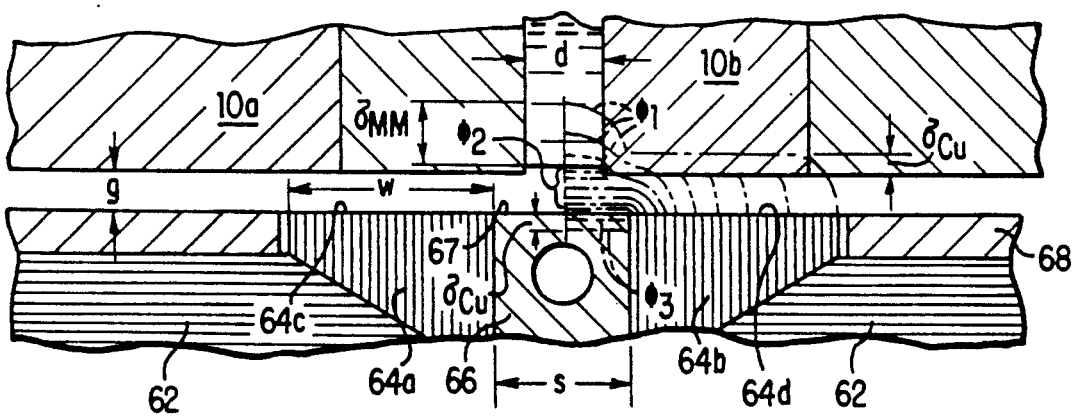
FIG. 19 is an enlarged, fragmentary, sectional view showing a portion of the apparatus shown in FIG. 18.

A further modification of the invention is shown by magnet 60, depicted in FIGS. 15, 16, 17, 18 and 19. In this embodiment, the surfaces of the magnet poles are perpendicular to the roll axes, and the flux is emitted from the pole surface in a direction parallel to the roll axes. As shown in FIG. 19, surface 67 of inner shield 66 lies in the same plane as the surfaces of magnet poles 64*a* and 64*b*, S>d, and the magnet pole surfaces 64 are separated from the roll surfaces by a gap g.

In contrast to the embodiment of FIGS. 1, 2, 3, 4 and 5, the inner shield 66 and outer shield 68 are next to magnet core 62, and excitation coil 69 is wound over a rear quadrant, or back leg 69*a* of magnet 60. In the preferred embodiment, excitation coil 69 is wound from insulated, thin, parallel connected copper sheets to reduce eddy current losses, and water-cooled heat sinks are embedded in the coil turns. In place of copper sheets, coil 69 may be wound from LITZ wire arranged around water-cooled heat sinks (copper tubes), for example, or from thin-walled water-cooled tubing.

Figure 18:
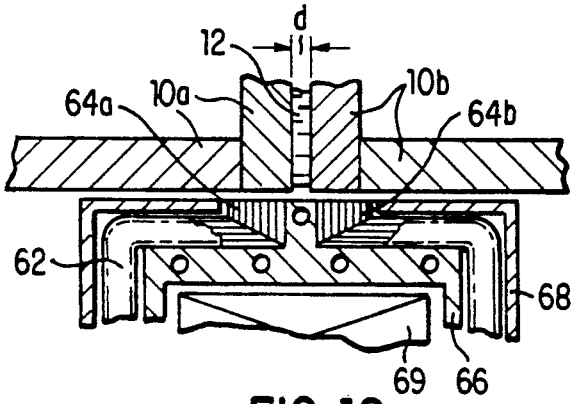
FIG. 18 is a sectional view taken along line 18—18 of FIG. 15.

Referring to FIGS. 18 and 19, the permeability of the ferromagnetic material is very much larger than the permeability of air, of the molten metal and of copper. Therefore, the magnetomotive force of coil 69 is, in first approximation, used to drive the flux between pole surfaces 64*c* and 64*d*. Flux density is inversely proportional to the length of the flux path; therefore, the flux density on pole surfaces 64*c* and 64*d* decreases with the horizontal distance from inner shield 66. The ratio of containment flux $\phi_1$, illustrated in FIG. 5, to total flux $$\Psi = \sum_{1}^{6} \phi_n.$$

is $\eta$ and depends on the circuit geometry and operating frequency. Shield fluxes $\phi_4$ and $\phi_5$ and leakage flux $\phi_6$ are much smaller than fluxes $\phi_1$, $\phi_2$ and $\phi_3$. Therefore, one can approximate $$\eta \approx \phi_1/(\phi_1+\phi_2+\phi_3) \tag{3}$$

Gap g, which separates rolls 10 and magnet 60, is determined by the thermal expansion of the rolls and the thickness of a layer of high temperature ceramic (not shown) covering the face of the magnet 60, if such a protective layer is used.

Figure 17:
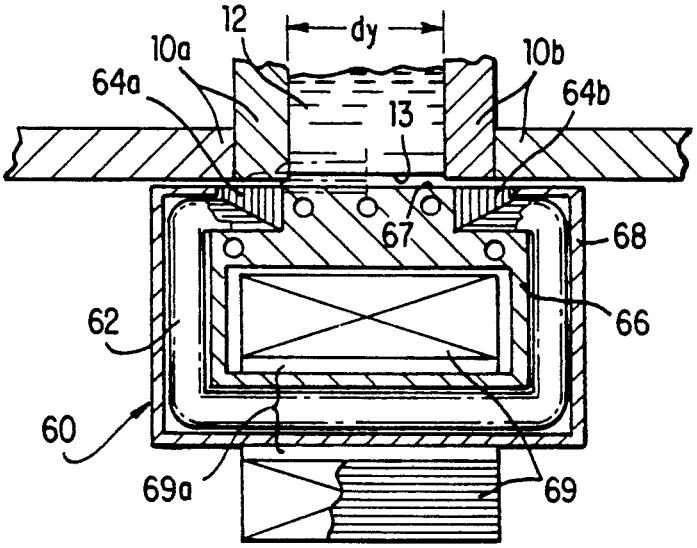
FIG. 17 is a sectional view taken along line 17—17 of FIG. 15.

For the geometries shown in FIGS. 17, 18 and 19, the field distribution can be established by the method of field plotting or with a suitable computer code. At the nip, as illustrated in FIGS. 18 and 19, most of the containment flux enters the molten metal from the circumference of the rollers.

The ratio of flux density in the sidewall of the molten metal, $B_{MM}$, to the flux density in the roller, $B_{Cu}$, next to the molten metal, is inversely proportional to the skin depth of the two materials $$B_{MM}/B_{Cu} \approx \delta_{Cu}/\delta_{MM}. \tag{4}$$

Containment flux $\phi_1$ is accumulated by the sidewall of the roll, and it increases with pole width w. Upon entering the roll sidewall, the flux is forced by eddy currents to flow horizontally in a layer equivalent to one skin depth $\delta_{Cu}$, causing flux compression. For an average flux density in the poles, $B_P$, the flux density at the roll surface is $$B_{Cu} \approx B_P \eta w/\delta_{Cu}. \tag{5}$$

Flux compression can be expressed as $$B_{Cu}/B_P \approx \eta w/\delta_{Cu}. \tag{6}$$

With wide magnet poles, the flux density at the roll edges can be made very much larger than what would be attainable with ferromagnetic inserts in the roll rims (the inserts are limited to their saturation flux density $\leqq$19 kG). Combining equations (4) and (5) gives the flux density in the molten metal skin depth as $$B_{MM} \approx B_P \eta w/\delta_{MM}. \tag{7}$$

For example, for the condition illustrated in FIG. 19, approximately 30% of the pole flux enters the roll sidewalls ($\eta \approx 0.3$). At 3 kHz the skin depth of molten steel and room temperature copper is 1.1 cm and 0.12 cm, respectively. For 3.3 cm wide pole faces and an average flux density of $B_P$=6 kG, the flux density in the molten steel is, from equation (7), $$B_{MM} \approx 6\ \text{kG} \times 0.3 \times 3.3\ \text{cm}/1.1\ \text{cm} = 5.4\ \text{kG}.$$

The peak flux density in the copper rolls would be, from equation (5), $$B_{Cu} \approx 6\ \text{kG} \times 0.3 \times 3.3\ \text{cm}/0.12\ \text{cm} = 49.5\ \text{kG}.$$

The ratio of the flux density $B_{INS}$ on the pole edge next to inner shield 66, to the flux density $B_{OUTS}$, on the pole edge next to the outer shield 68, is $$B_{INS}/B_{OUTS} \approx (S+2W)/S. \quad (8)$$

For the conditions shown in FIG. 19, the ratio is $$B_{INS} \approx \frac{2.2\text{ cm} + 2 \times 3.3\text{ cm}}{2.2\text{ cm}} B_{OUTS} \approx 4\, B_{OUTS}.$$

It is important that these differences in flux density do not cause saturation or excessive losses on the inside of the poles and the core. For desired values of d, g and S at the nip, the pole width w and flux densities of the containment magnet can be optimized for a desired molten-metal-pool height from equations (3), (7) and (8).

Figure 20:
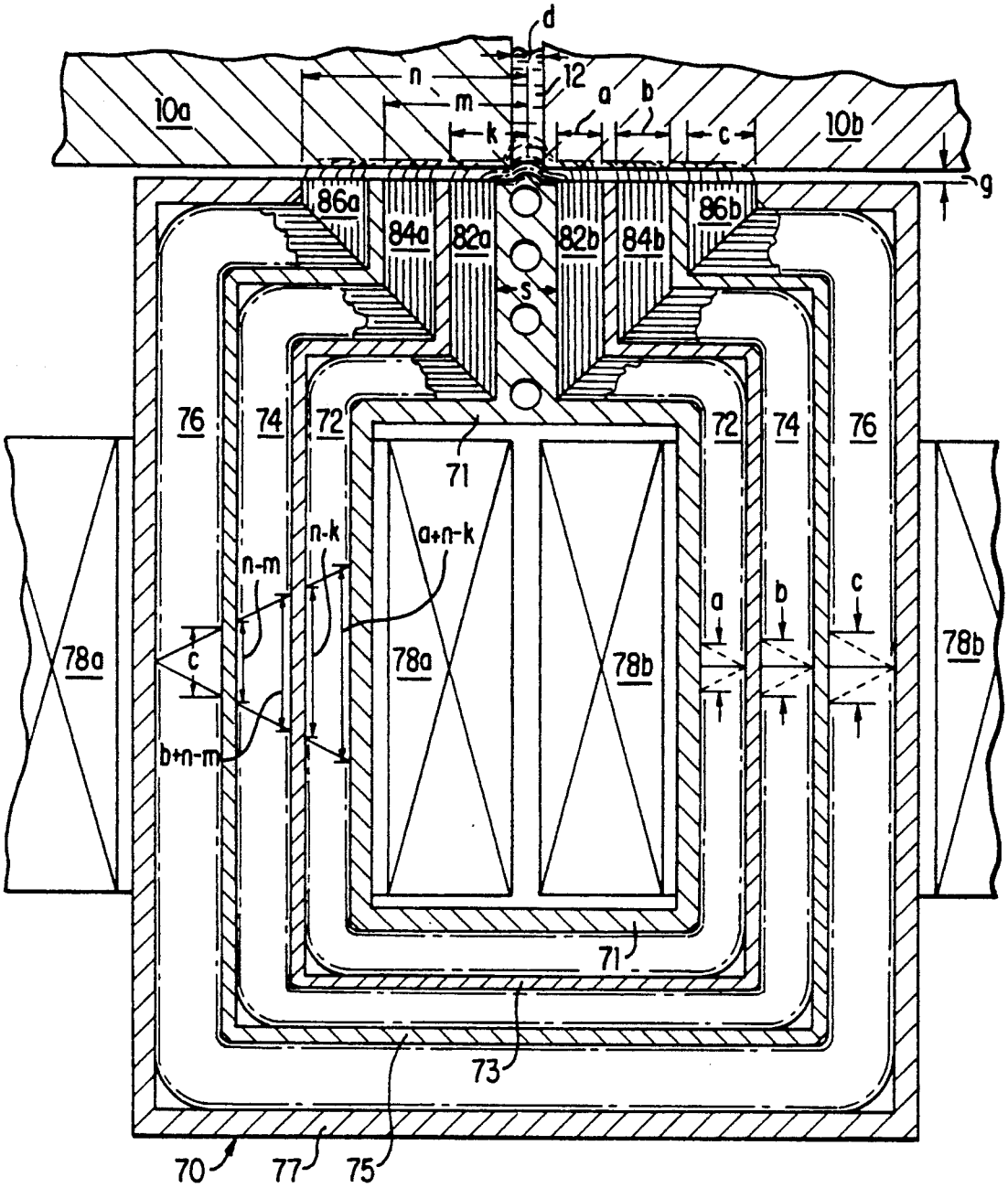
FIG. 20 is a horizontal, sectional view showing another embodiment of an apparatus in accordance with the present invention, associated with a pair of rolls of a continuous strip caster.

FIG. 20 depicts a horizontal sectional view through the nip of magnet 70 of the present invention. A large effective pole width is achieved by providing three cores 72, 74, 76 separated by copper shields 73, 75 and enclosed by inner shield 71 and outer shield 77. These shields also act as heat sinks. Cores 72, 74, 76 have poles 82*a*, 84*a*, 86*a* on the left and poles 82*b*, 84*b* and 86*b* on the right side of inner shield 71; their pole widths are "a", "b", and "c", respectively. The effective pole width is w=a+b+c. FIG. 20 illustrates three of many different modes of flux control possible with this embodiment of the invention.

Referring to the right half section of FIG. 20 and cores 72, 74 and 76 without air gaps, the ratios of the flux density on the inside, $B_{INS}$, to the flux density on the outside, $B_{OUTS}$, for poles 82*b*, 84*b* and 86 *b* is $$\frac{B_{INS}}{B_{OUTS82b}} : \frac{B_{INS}}{B_{OUTS84b}} : \frac{B_{INS}}{B_{OUTS86b}} \approx \frac{2K}{S} : \frac{2m}{2m-2b} : \frac{2n}{2n-2c}. \quad (9)$$

With excitation coils 78*a* and 78*b* common to all cores, the ratio of peak flux density in poles 82, 84 and 86 is $$\hat{B}_{82} : \hat{B}_{84} : \hat{B}_{86} \approx \frac{1}{S} : \frac{1}{2m-2b} : \frac{1}{2n-2c}. \quad (10)$$

By providing triangular-shaped cuts in cores 72, 74 and 76, with bases at the inner core surfaces equal to the pole widths of the respective cores, and the apexes at the other surfaces, as shown in dashed lines in the right half section of FIG. 20, the flux density over each pole width "a", "b", and "c" is constant ($B_{INS}=B_{OUTS}$), and the ratios of flux density become $$B_{82} : B_{84} : B_{86} \approx \frac{1}{S+2a} : \frac{1}{2m} : \frac{1}{2n}. \quad (11)$$

The dotted flux lines in the right half section in FIG. 20 illustrate the condition for equation (11) and flux $\phi_1$.

Referring to the left half section of FIG. 20, with cores 72, 74 and 76 having a triangular-shaped cut formed through all three cores, with relative dimensions as shown, the reluctance of all three magnetic circuits is approximately equal, and there is no flux density gradient across the poles. As illustrated by the dotted lines in the left half section, the flux density is the same on all three poles $$B_{82} = B_{84} = B_{86} a \tfrac{1}{2} n. \quad (12)$$

The relatively large air gaps in cores 72 and 74 formed by the triangular-shaped cut formed through cores 72, 74 and 76 could be subdivided to reduce eddy current losses in the portions of shields 71, 73 and 75 that surround these gaps.

Figure 21:
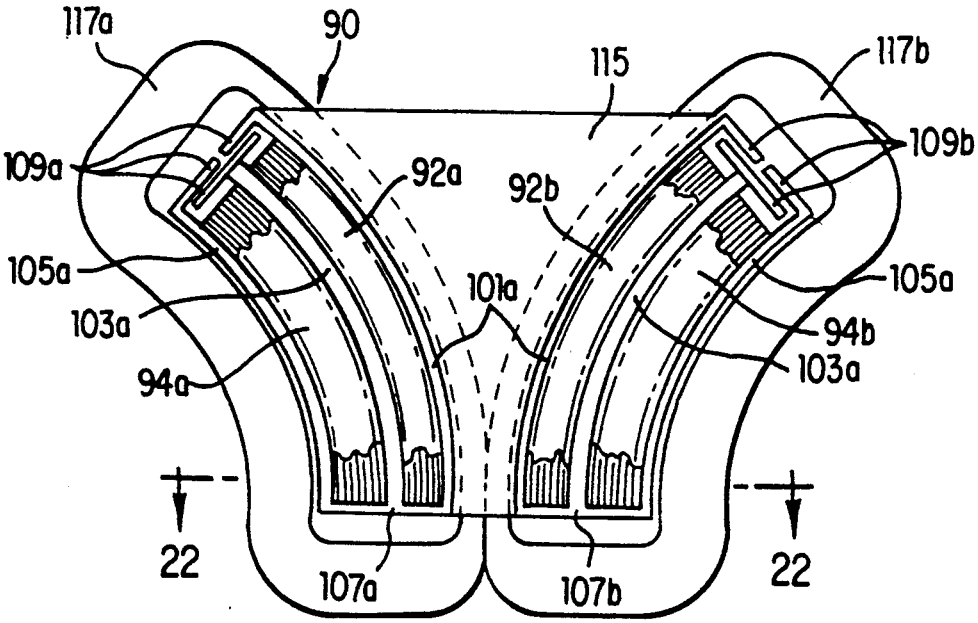
FIG. 21 is a front view of another embodiment of the magnetic confinement apparatus of the present invention.
Figure 22:
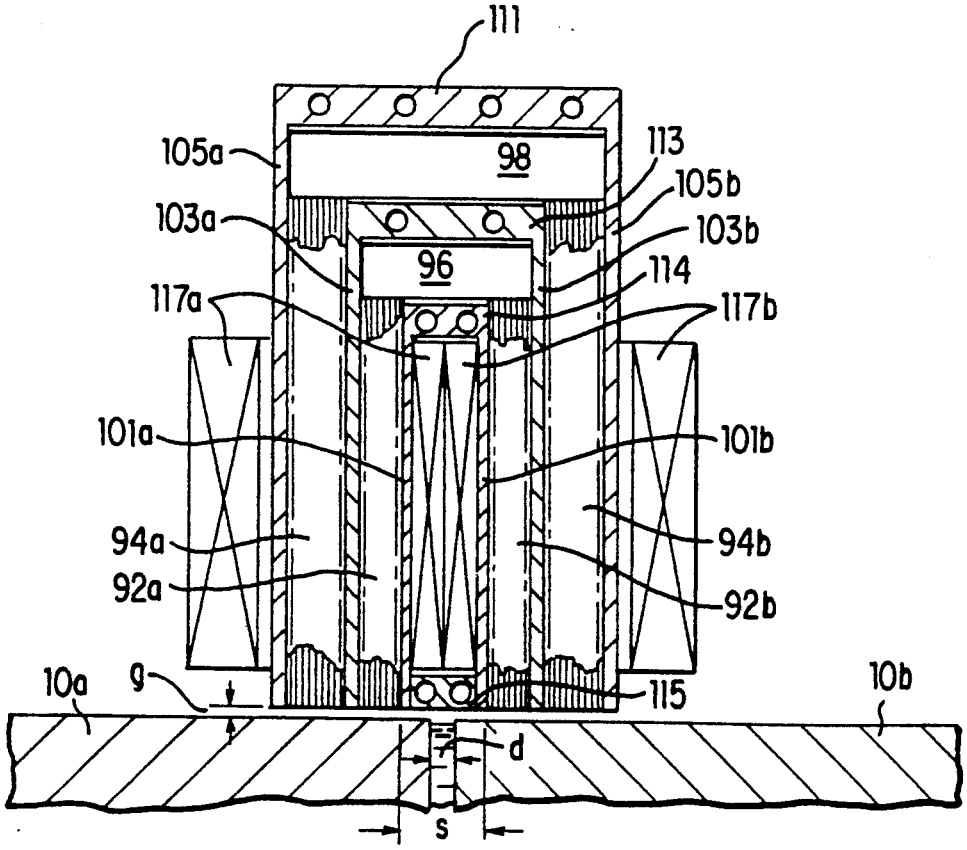
FIG. 22 is a sectional view taken along the line 22—22 of FIG. 21 indicating the position of the magnet in front of the rolls.
Figure 23:
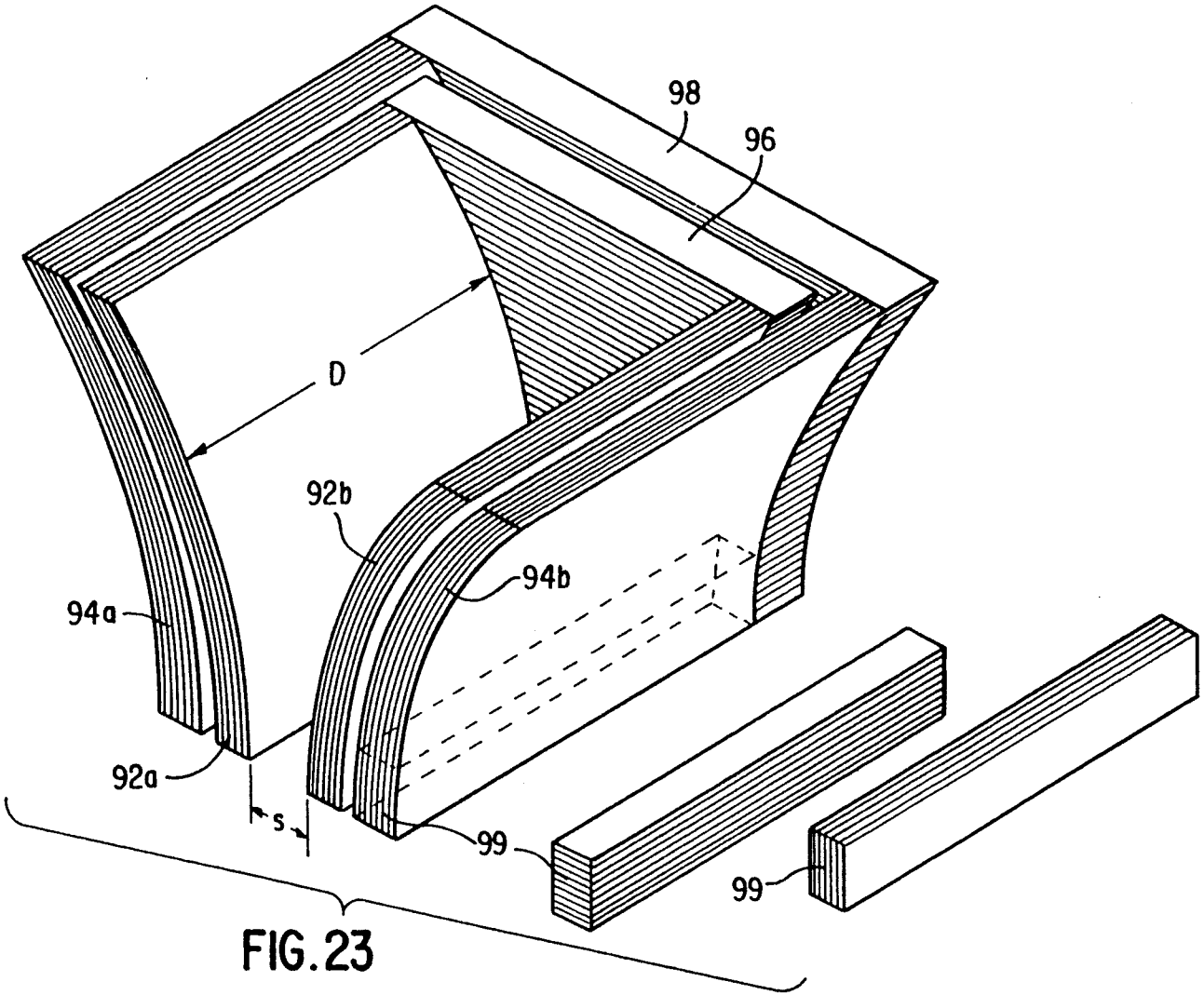
FIG. 23 is a perspective of the magnetic core of the embodiment shown in FIG. 21.

Still another embodiment of this invention is shown in FIGS. 21, 22 and 23. Magnet 90 uses arc-sections cut from two tape-wound ferromagnetic cylinders. A relatively short cylinder is used to prepare arcs for core sections 92*a*, 92*b*, and a taller cylinder, having a smaller diameter, is used for the outer core sections 94*a* and 94*b*. The core-faces disposed opposite rolls 10*a* and 10*b* represent the magnet poles. The other end of cores 92*a* and 92*b* is bridged by a ferromagnetic yoke 96 and cores 94*a* and 94*b* are bridged by a ferromagnetic yoke 98. FIG. 23 shows the ferromagnetic components; they are magnetically equivalent to the assembly shown on the right hand side of FIG. 20 if the outer-most magnetic cores 76 and poles 86 are removed from FIG. 20. Both the magnet of FIG. 20 and the magnet of FIG. 21 can have more or fewer core and pole sections in parallel, depending on the application and on the desired effective pole width w.

The core and yoke of magnet 90 are enclosed in non-shorting, water-cooled, eddy current shields comprising arced-sections 101, 103 and 105 with end-sections 111, 113, 114 and 115, bottom sections 107 and top sections 109. Depth D of the inner core assembly is determined by the selection of inner pole separation S and the area (S×D) required to accommodate coils 117, shields 101 and end sections 114 and 115.

For large roll diameters it may not be practical to fabricate large, tape-wound cylinders. In this case, the cores of magnet 90 can be made from a large number of identical laminated sections 99 (bricks or building blocks) as shown in FIG. 23. These sections 99 may have their laminations in a horizontal or vertical plane. A vertical orientation of laminations will result in smaller eddy current losses in the surrounding shields.

Figure 24:
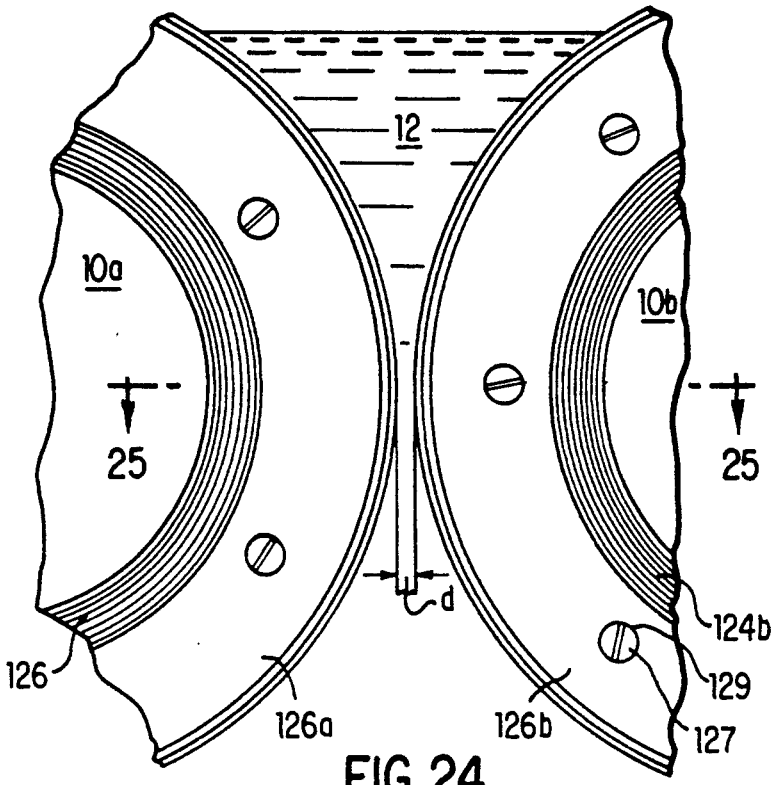
FIG. 24 is an end view of rolls and roll-mounted ferromagnetic disks in accordance with one embodiment of the present invention.
Figure 25:
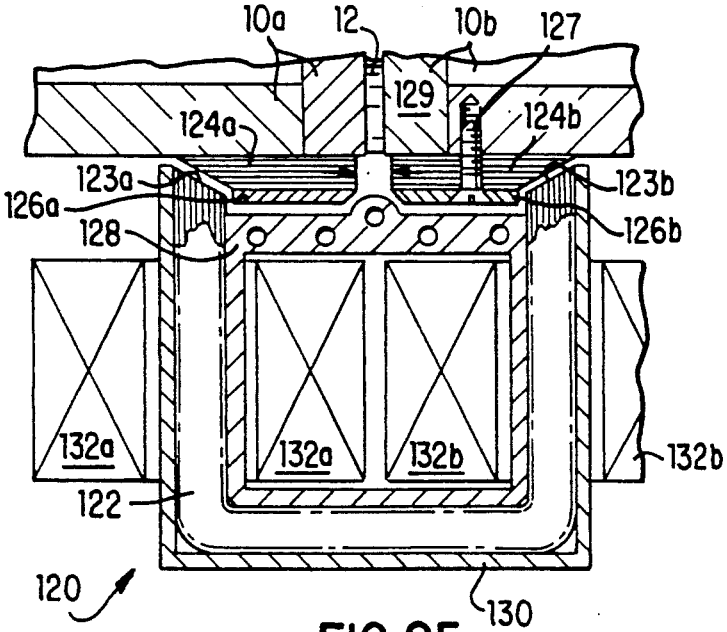
FIG. 25 is a sectional view taken along line 25—25 of FIG. 24.
Figure 26:
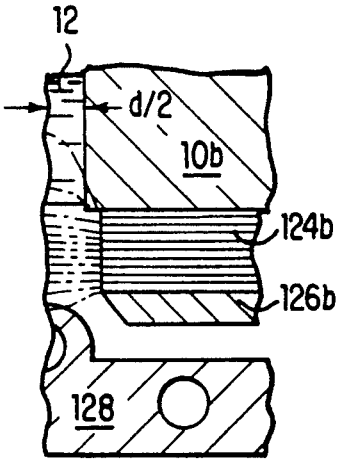
FIG. 26 is an enlarged, fragmentary, sectional view of the embodiment shown in of FIG. 25.

Another embodiment of this invention is depicted in FIGS. 24, 25 and 26. This embodiment presents a combination of a large number of thin, insulated, ferromagnetic disks 124, mounted to rolls 10 and a separate stationary magnet 120 which magnetizes the rotating disks 124. FIG. 24 shows ferromagnetic disks 124*a* mounted to roll 10*a* via solid copper disk 126*a* by means of screws 127 and insulating bushings 129. Ferromagnetic disks 124*b* are mounted to roll 10*b* via copper disk 126*b* by screws 127 and insulating bushing 129. Magnet 120 shown in the cross-sectional view of FIG. 25 consists of core 122 enclosed by inner shield 128 and outer shield 130. These shields are electrically connected; a gap between the two shields prevents the shields from being a shorted turn. Excitation coils 132*a* and 132*b* enclose the shielded core.

FIG. 26 is an enlargement of one-half of the nip of FIG. 25 illustrating the flux distribution. The embodiment of FIGS. 24 and 25 cause much fewer eddy current losses in roller 10 than the previous embodiments because very little flux penetrates the rolls. This is especially true when S=d. In contrast to magnets 20, 30, 40, 60, 70 and 90, the combination of magnet 120 and disks 124 produces a field that is essentially perpendicular to the roller axis even when $S \leqq d$. As illustrated by FIGS. 4, 6, 13 and 14 this is not the case with the earlier magnets. For $S=d$, and the combination of roll-mounted disks 124 and magnet 120, the molten metal will be contained closer to the edge of rolls 10, as is the case with the earlier magnets. The attainable pool heights are limited by disk and core saturation. A disadvantage of roll-mounted ferromagnetic disks is the large, circular leakage field emitted by the disks outside the pool area.

For $S>d$, the magnetic field produced by magnet 120 and transmitted via disks 124 to the edges of rollers 10 and the sidewall of molten metal pool 12, can be made much larger than what would be required for sidewall containment. In this embodiment of the invention the containment uses the eddy-current-shielding effect of copper rollers 10 to limit the push-back of the sidewall of pool 12; equation (1) shows the rapid attenuation of the field as a function of distance x from the surface. This magnetic field that is substantially larger than required for containment can be provided by any of the magnets shown throughout the drawings.

Figure 27:
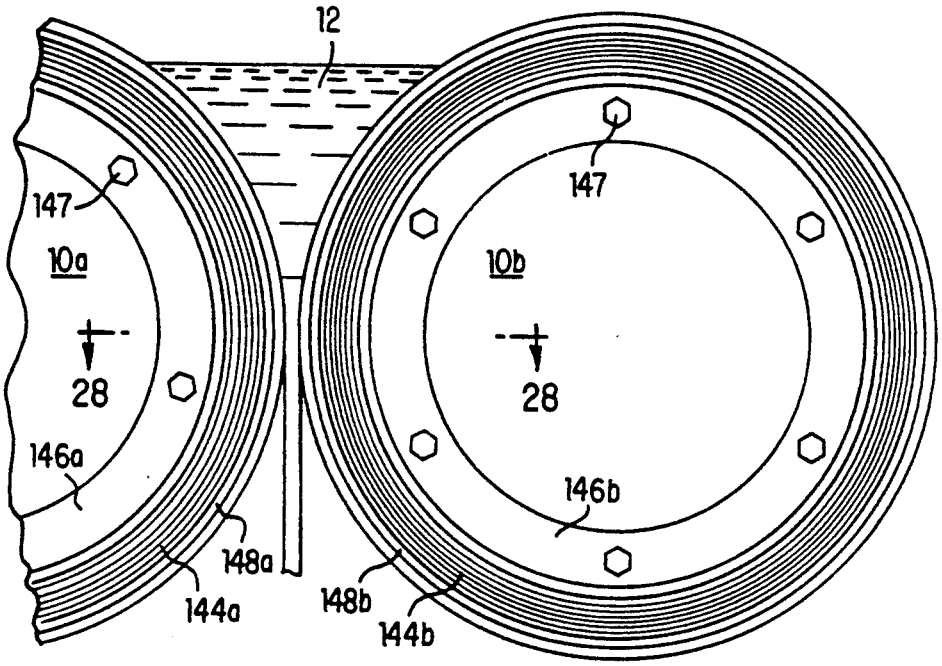
FIG. 27 is a view similar to FIG. 24 showing roll-mounted, ferromagnetic toroids in accordance with another embodiment of the present invention.
Figure 28:
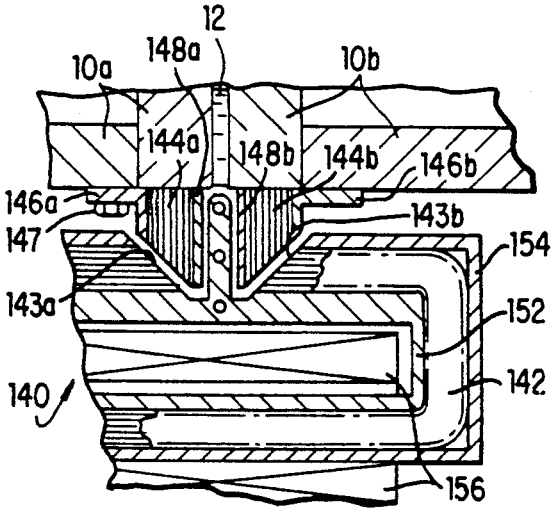
FIG. 28 is a sectional view taken along line 28—28 of FIG. 27, showing another embodiment of a magnetic core.
Figure 29:
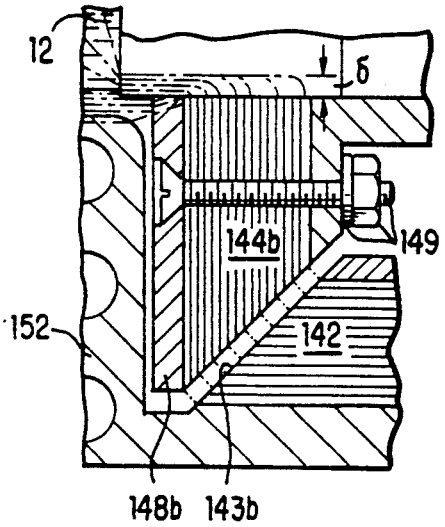
FIG. 29 is an enlarged, fragmentary, sectional view of the embodiment shown in FIG. 28.

A further modification of the magnet is depicted in FIGS. 27, 28 and 29. This embodiment presents a combination of tape-wound ferromagnetic toroids 144 mounted to rolls 10 and a separate stationary magnet 140 for magnetizing the rotating toroids 144. FIG. 27 shows the ferromagnetic toroid 144*a* mounted to roller 10*a* by means of solid copper cylinders 146*a*, 148*a*, screws 147 and insulated mounting hardware 149. Ferromagnetic toroid 144*b* is mounted in similar fashion to roll 10*b*.

A cross-sectional view of magnet 140 is shown in FIG. 28. It consists of core 142 enclosed by inner shield 152 and outer shield 154. The shields 152 and 154 are electrically connected, and a gap prevents the shields from being a shorted turn. Excitation coil 156 encloses the shields. Shield 152 protrudes into the gap between toroid assemblies 144 for field shaping and to reduce leakage flux as illustrated by FIG. 29. The combination of roll-mounted toroids 144 and magnet 140 is more efficient than magnet 60 to force the containment field into rollers 10. The losses in the pole of magnet 140 are small, compared to magnet 60. These advantages have to be weighed against the additional complication of roll-mounted toroids 144 and the larger leakage flux that is emitted from the open surface of the toroids.

Figure 30:
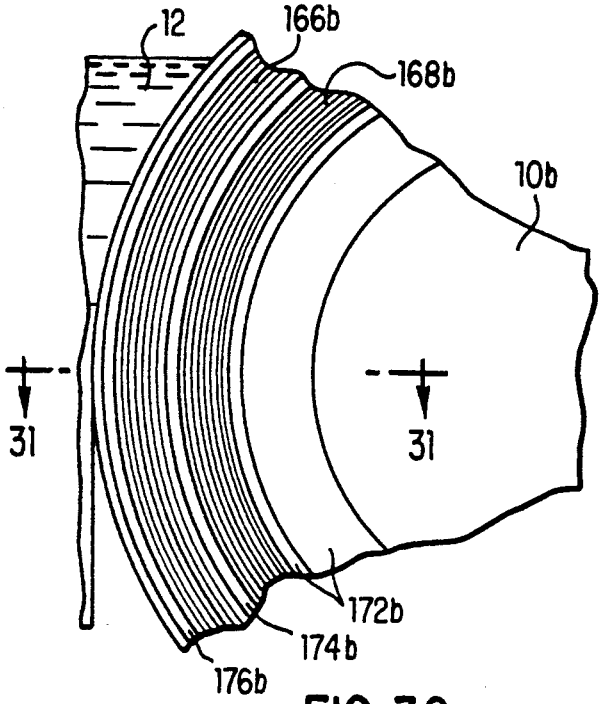
FIG. 30 is an end view, partially broken-away, showing another embodiment of roll-mounted, ferromagnetic toroids.
Figure 31:
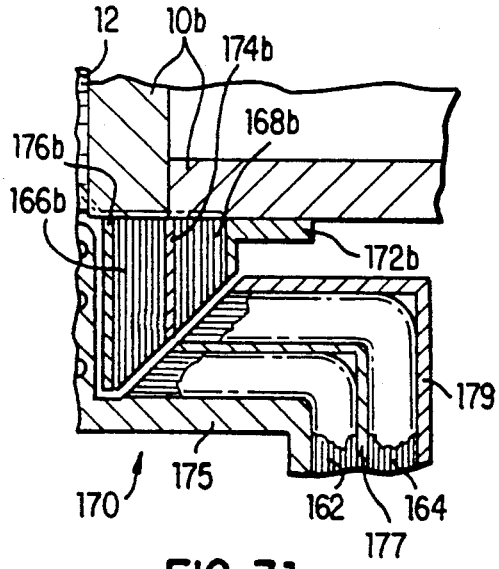
FIG. 31 is a sectional view taken along the line 31—31 of FIG. 30, showing a magnetic core.
Figure 32:
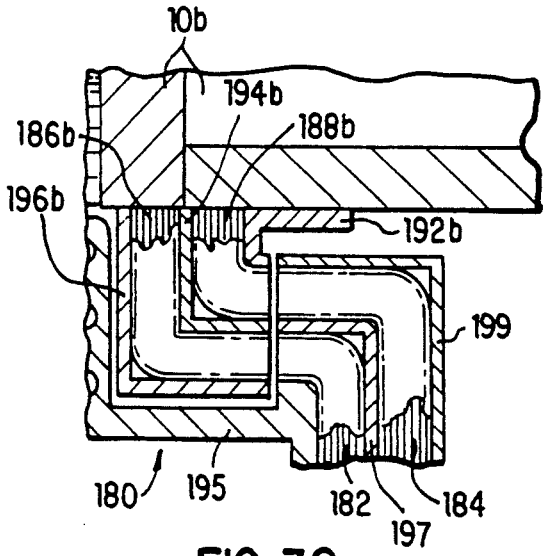
FIG. 32 is a view similar to FIG. 31 showing still another embodiment of a magnetic core.

A still further embodiment of the magnet design is depicted in FIGS. 30, 31 and 32. Larger pool depths require larger fields near the bottom of the pool. In FIG. 30, two toroids 166*b* and 168*b* are placed between copper hoops 172*b*, 174*b* and 176*b* and are mounted to roll 10*b*. Similarly, a pair of toroids 166*a* and 168*a* are mounted to roll 10*a*. FIG. 31 is a cross section through the right half of the sidewall containment assembly depicting the pole mounted toroids 166*b* and 168*b* and their corresponding core sections 162 and 164 of stationary magnet 170. Cores 162 and 164 are embedded in shields 175, 177 and 179. Inner shield 175 is used for field-shaping opposite the sidewall of molten metal and to reduce leakage flux. The excitation coil (not shown) encloses the shields at the back yoke of the magnet.

FIG. 32 shows an embodiment utilizing two sets of roll-mounted quadrants, 186*b* and 188*b*, mounted around the circumference of rolls 10*b* and magnet 180 for sidewall containment. Quadrant sets 186*b* and 188*b* around the roll circumference are embedded in copper hoops 192*b*, 194*b* and 196*b* and mounted to roll 10*b*. Cores 182 and 184 of magnet 180 are embedded in shields 195, 197 and 199. Shield 195 is also used for field shaping for the sidewall of the molten metal. The excitation coil (not shown) encloses the shields at the back of the magnet.

Figure 33:
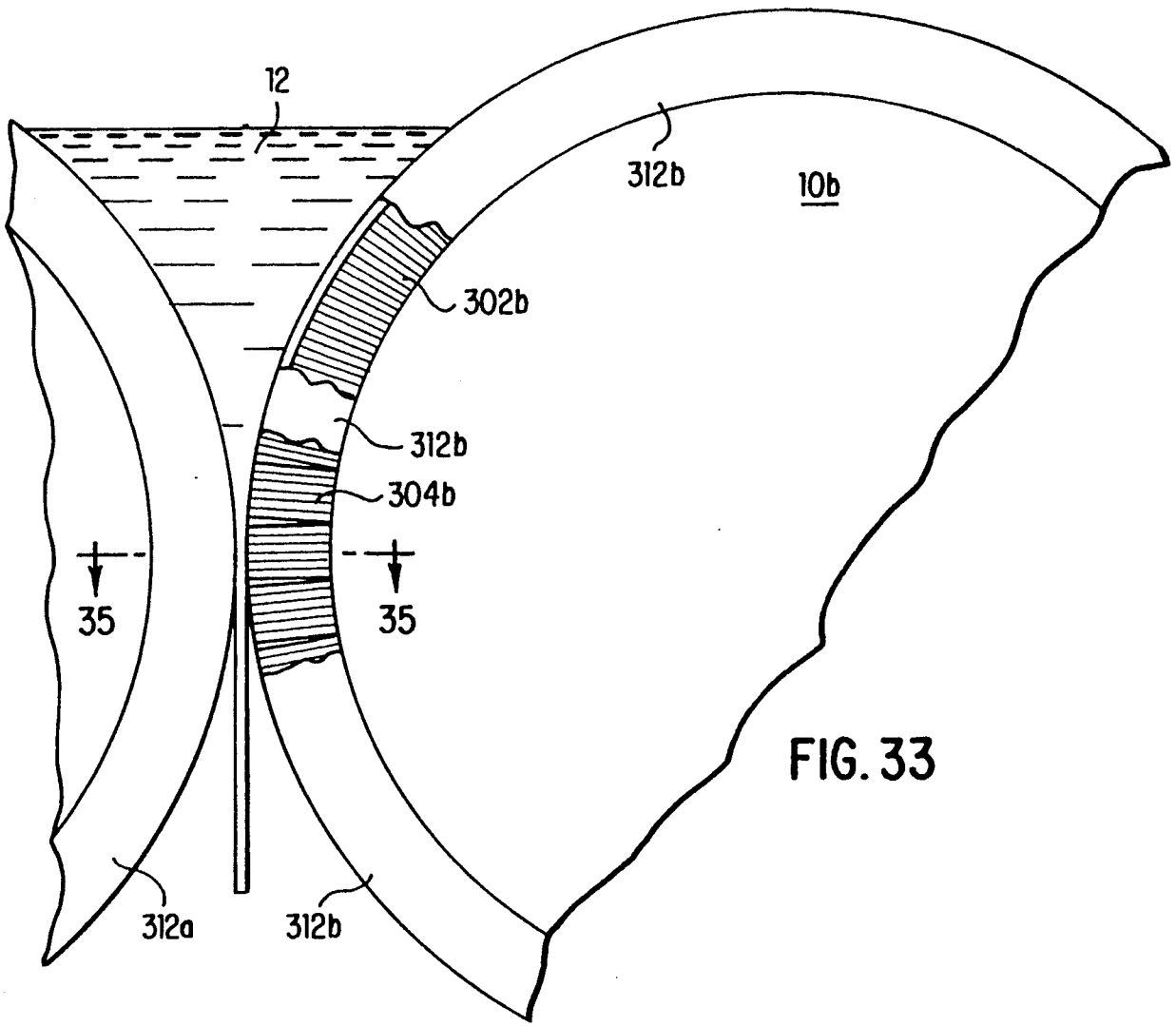
FIG. 33 is an end view, partially broken-away, showing another embodiment of roll-mounted, ferromagnetic inserts having a laminated form.
Figure 34:
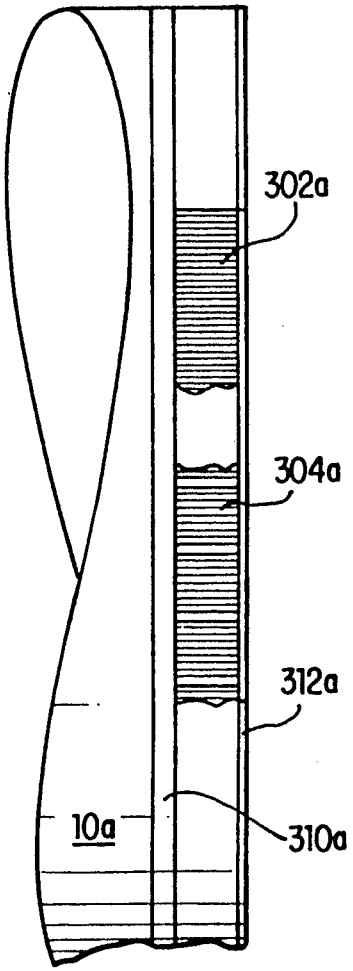
FIG. 34 is a side view of the ferromagnetic roll-mounted inserts of FIG. 33.
Figure 35:
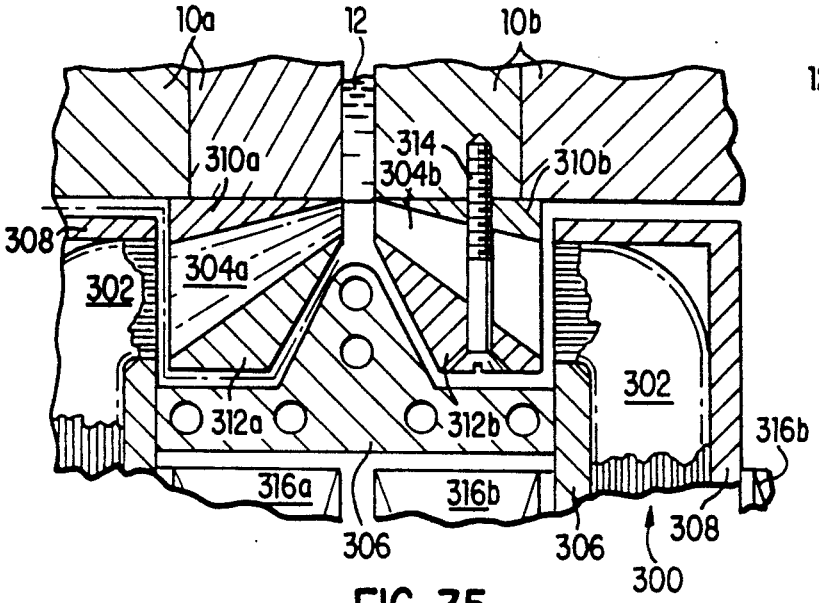
FIG. 35 is a sectional view taken along line 35—35 of FIG. 33.
Figure 36:
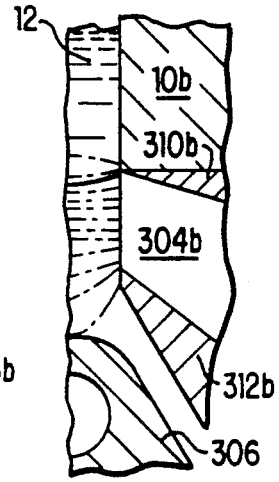
FIG. 36 is an enlarged, fragmentary, sectional view of the roll-mounted, ferromagnetic inserts of FIG. 35.

Other embodiments of electromagnetic sidewall containment designs are depicted in FIGS. 33, 34, 35, 36, 37 and 38. These embodiments present combinations of roll-mounted ferromagnetic laminations oriented in a direction that is shifted 90° from the orientation of the ferromagnetic, roll-mounted, laminations of FIGS. 25, 28, 31 and 32; and a separate, stationary magnet 300 for magnetizing the rotating laminations. This lamination orientation prevents the large circular leakage flux associated with roll-mounted disks (FIG. 25) and roll-mounted toroids (FIGS. 28 and 31). The quadrant sets of FIG. 32 also reduce this leakage flux. As depicted in FIGS. 33 and 34, laminations may be distributed uniformly around the circumference of the rolls individually, as designated by reference numeral 302, or they may be arranged in multiple, equally wide packages, as designated by reference numeral 304. FIGS. 34 and 35 show ferromagnetic packages 304 sandwiched between copper disks 310 and 312 and mounted with insulated hardware 314 to roll 10. Magnet 300 consists of core 302 enclosed in shields 306 and 308. Excitation coils 316 enclose the shield and core assembly. Inner shield 306 is also used to shape the field in the sidewall of the molten metal. On the left side of FIG. 35, the major flux paths of core 302 are shown by dotted lines. FIG. 36 depicts, with dotted lines, the magnetic field distribution through ferromagnetic portion 304*a* and 304*b* of the laminations. Ferromagnetic portion 304*b* (FIG. 36) is in contact with the roll edges at 309. As shown in FIGS. 35 and 36, ferromagnetic packages 304 are shaped for flux compression such that the flux density at the pole face near the nip is approximately three times the flux density at the pole face near pole 302.

Figure 37:
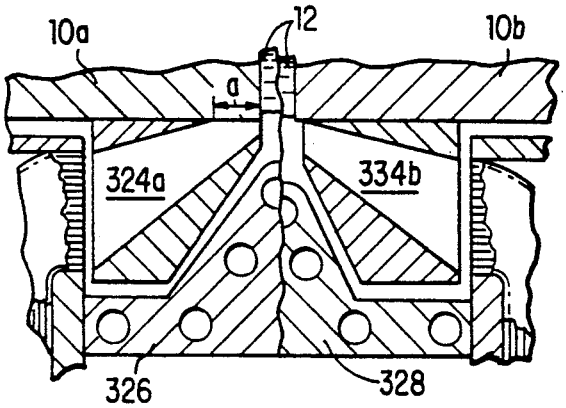
FIG. 37 is a view similar to FIG. 35 showing two separate embodiments of core and roll design.
Figure 38:
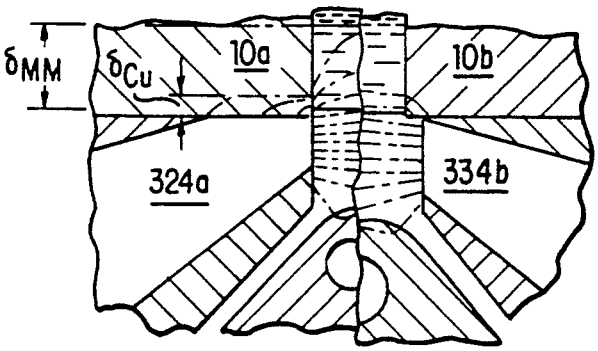
FIG. 38 is an enlarged, fragmentary, sectional view of the subject matter of FIG. 37.
Figure 39:
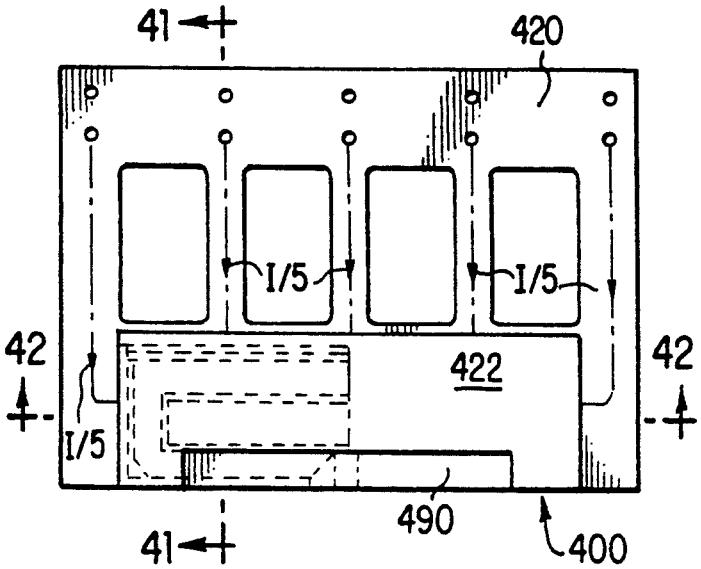
FIG. 39 is a top view of a magnet in accordance with this invention having a single turn excitation coil which also serves as an electromagnetic shield.
Figure 40:
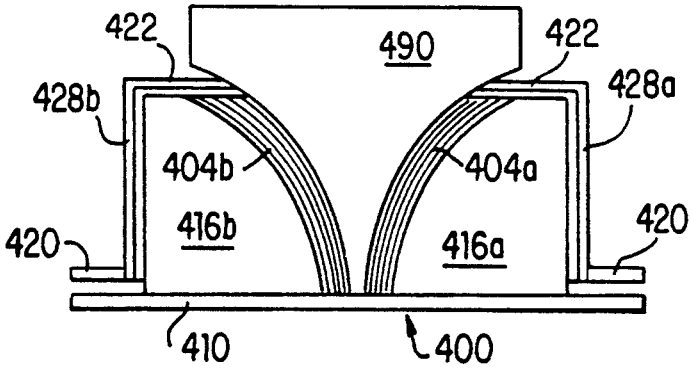
FIG. 40 is a front view of the embodiment of FIG. 39.

FIG. 37 depicts two different embodiments for the roller-mounted laminations. On the right half of FIG. 37 the laminations 334*b* are set back from the edge of roll 10*b* resulting in a field distribution as shown enlarged in the right half of FIG. 38. As shown in FIG. 37, the molten metal is pushed back further, as compared to the conditions shown by FIGS. 35 and 36. On the left half of FIG. 37, laminations 324*a* are not only flush with the edge of roll 10*a* that is touching the molten metal, they are also touching the other side of the roll edge over a distance shown as "a". As shown enlarged on the left half of FIG. 38, this feature increases the field in the liquid metal, pushing it further back.

Figure 44:
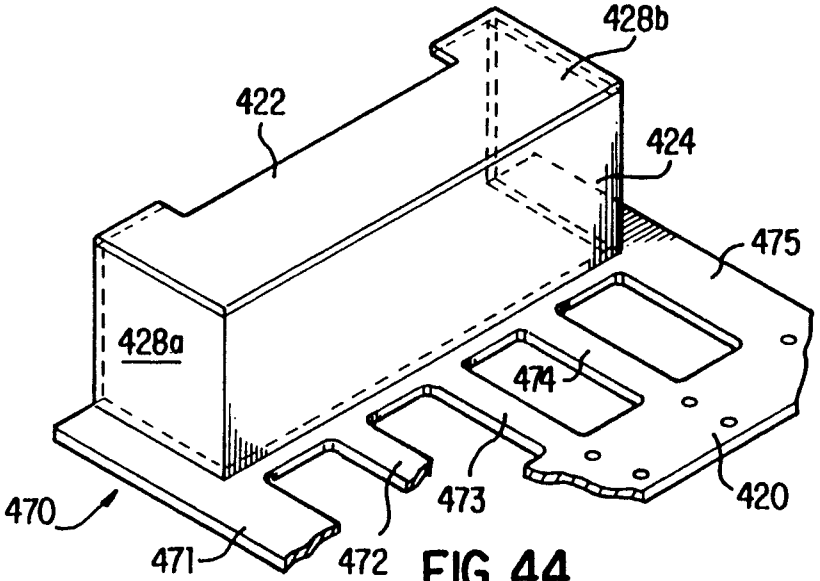
FIG. 44 is a perspective of the upper half of the excitation coil depicted in FIGS. 39, 40, 41 and 42.
Figure 41:
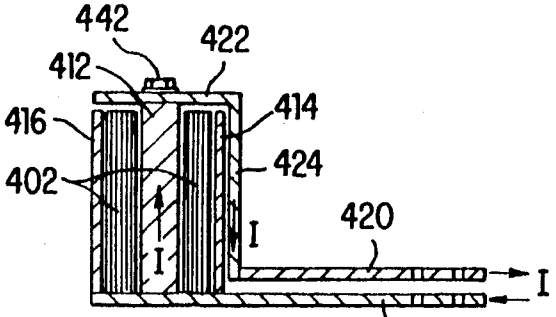
FIG. 41 is a sectional view taken along the line 41—41 of FIG. 39.
Figure 43:
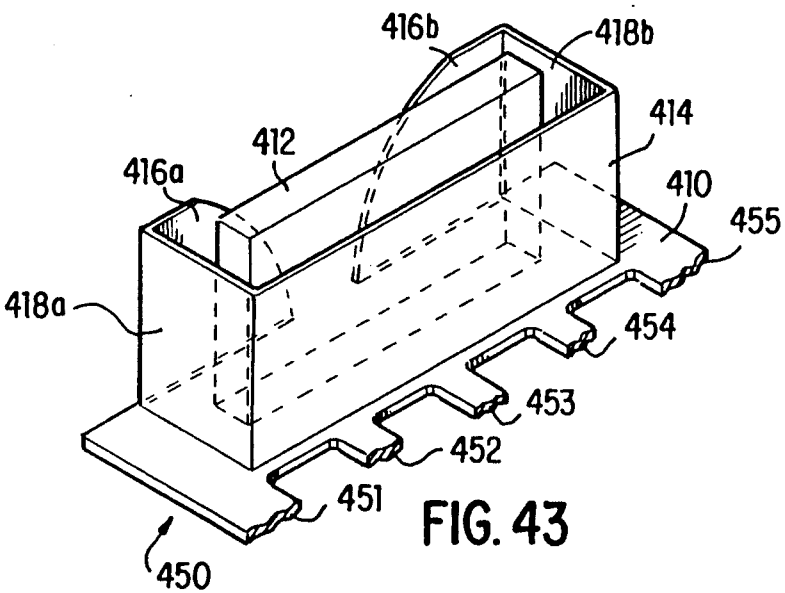
FIG. 43 is a perspective of the lower half of the excitation coil depicted in FIGS. 39, 40, 41 and 42.

A still further modification of the invention is shown by magnet assembly 400 depicted in FIGS. 39 through 44. In this embodiment, magnet core 402 is enclosed by a single-turn coil comprising a lower-half, 450 (FIG. 43), and an upper half, 470 (FIG. 44). Coil halves 450 and 470 are made from copper and they also act as electromagnetic shields for magnet core 402. Terminal plate 410 of the lower coil half 450 is brazed to center piece 412 and sidewalls 414, 416 and 418. Terminal plate 420 of the upper coil half 470 is brazed to sidewalls 424, 428 and top plate 422. The top surface of center piece 412 and the mating bottom portion of plate 422 are silver plated to facilitate good electrical contact when the upper coil-half 470 is bolted to the lower coil half 450 with hardware 442 to complete the excitation circuit. As depicted by arrows signifying the direction of current I in FIGS. 41 and 42, the magnet current I flows from terminal plate 410 up through center piece 412 into top plate 422 and down through outer sidewalls 424 and 428 into upper terminal plate 420. Sidewalls 414, 416 and 418 of the lower coil half do not carry current; the presence of sidewalls 414, 416 and 418 reduces leakage flux by increasing the reluctance of the leakage-flux-paths.

Current distribution is made more uniform by cutting slots in terminal plates 410 and 420. The resulting currents paths 451, 452, 453, 454 and 455 in plate 410 and paths 471, 472, 473, 474 and 475 in plate 420 have approximately equal resistance, forcing a current pattern as indicated by dotted lines in FIG. 39. Circuit losses are minimized by fabricating the coil parts from copper sheets having a thickness of approximately 2 to 4 times the skin depths of the magnet current. An exception to this may be the center piece 412 which may be made from a thicker piece of copper.

Figure 42:
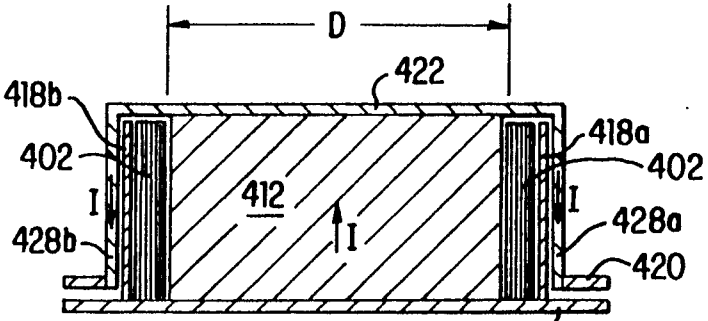
FIG. 42 is a sectional view taken along the line 42—42 of FIG. 39.

The length of the magnet core window, shown in FIG. 42 as dimension D, has a minimum which is determined by the arc of the pole faces 404; its maximum is determined by the current density chosen for the magnet coil.

Water cooling may be provided for parts of the coil assembly by brazing copper tubing to terminal plates 410 and 420 and to surface plates 422, 424 and 428. Holes (not shown) may be drilled through bottom plate 410 and into center piece 412 to circulate cooling water.

Pole faces 404*a* and 404*b* may be set back from the outer sidewalls 416 (similar to the arrangement shown in FIG. 5), or they may be flush with the outer sidewalls 416 (similar to FIGS. 17 and 18), or they may protrude (similar to FIGS. 7, 12 and 25) to facilitate containment of the sidewall of molten metal.

A solid copper piece 490 is located between pole faces 404 to shape the magnetic field between the containment magnet, the rolls and the molten metal sidewall which is being contained electromagnetically. The surface of copper piece 490 facing the molten metal may be shaped similar as the surfaces of the inner shields, as shown, for example, in FIGS. 4, 5, 6, 7, 17 and 18. Solid copper piece 490 may be insulated from the coil and core assembly or it may be an integral part of center piece 412 without producing the effect of a shorted turn for the core flux. Water cooling is provided for copper piece 490 be means of copper tubing brazed to it (not shown) and/or by holes drilled into it (not shown).

Figure 45:
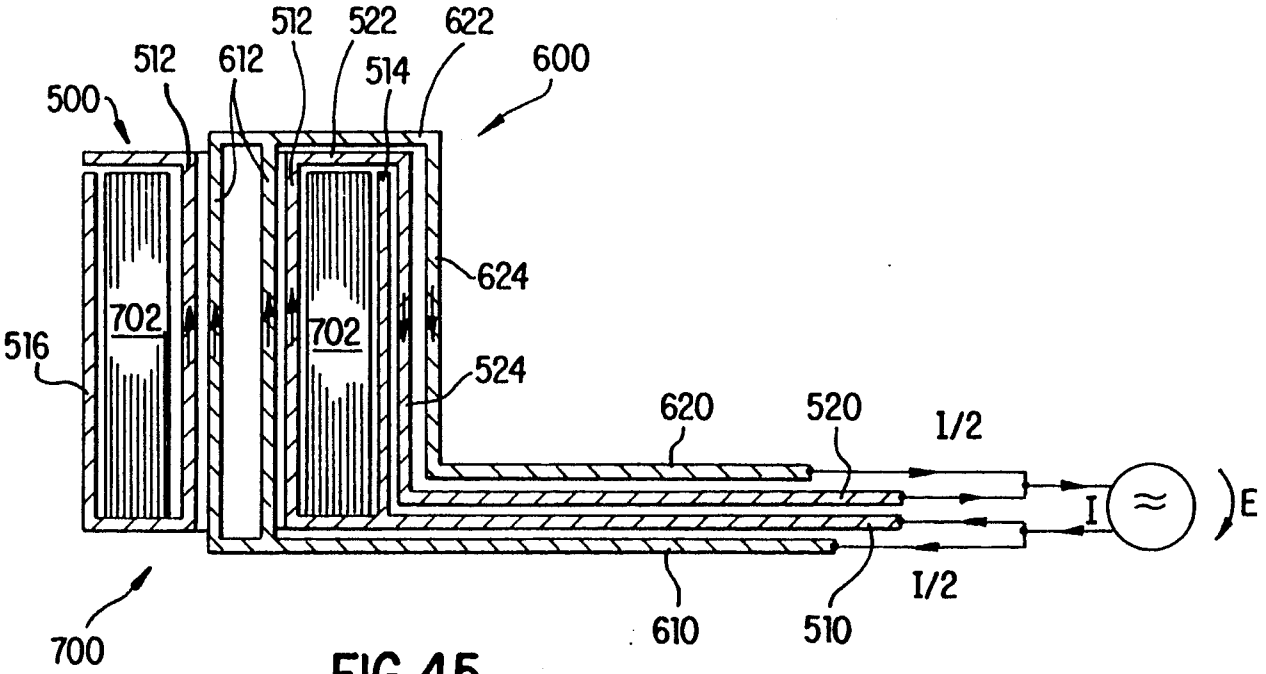
FIG. 45 is a sectional view similar to the view along section line 41—41 of FIG. 39 depicting a single turn excitation coil comprising two nested coil assemblies operating in parallel.

Magnet assembly 700, shown in FIG. 45, is another variation of the present invention. FIG. 45 is a sectional view similar to FIG. 41 for magnet 400. The coil of magnet 700. is designed for applications where very large values of ampere-turns are required to contain the sidewalls of deep pools of molten metal between large diameter rolls.

Part of the excitation coil assembly acts as an eddy current shield to reduce leakage flux of core 702. The magnet coil in FIG. 45 comprises an inner coil assembly 500 which is enclosed and insulated from an outer coil assembly 600.

With two coil assemblies, each made from copper sheets of a thickness approximately 2 to 4 times the skin depths of the magnet current, the coil current losses are cut approximately in half as compared to the design of magnet 400.

Construction of the inner coil assembly is nearly identical to that of the coil of magnet 400 shown in FIGS. 39 through 44. As shown in FIG. 45 half of the excitation current, I/2, flows from terminal plate 510 of the inner coil assembly, 500, up through center piece 512 through top plate 522 and back down through the side plates (of which only plate 524 is visible in FIG. 45) to the upper terminal plate 520. The second half of the excitation current enters terminal plate 610 of the outer coil assembly, 600, flows up through center piece 612 into top plate 622 and down the side plates (only plate 624 is shown) into terminal plate 620. Inner coil assembly 500 has sidewalls 514, 516, and 518 (518 is not shown in FIG. 45, it is similar to sidewalls 418*a* and 418*b* of magnet assembly 400) which do not carry current; their presence reduces leakage flux by increasing the reluctance of the leakage-flux-paths. The coil assemblies of FIG. 45 are brazed together in stages.

Figure 46:
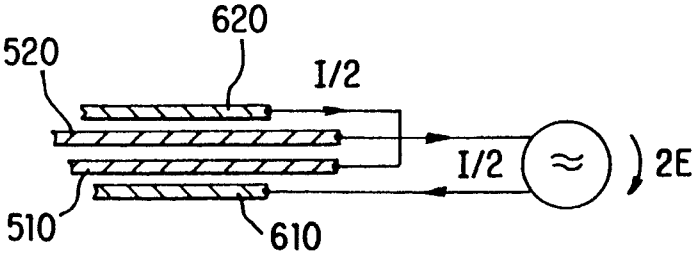
FIG. 46 shows the terminals of two nested coil assemblies, similar to the assemblies of FIG. 45, connected in series for two turn operation.

As illustrated by FIG. 46 coil assemblies 500 and 600 can also be connected in series for applications where a smaller power supply current and a higher power supply voltage are desired.

For still larger currents more than two coil assemblies can be nested and connected in parallel or in series utilizing the design principles outlined by FIGS. 45 and 46. In addition, the window length of the magnet core (dimension D of FIG. 42) may be increased, thereby increasing the cross section of the correspondingly increased number of copper plates (510, 512, 520, 524; 610, 612, 620, and 624).

Magnet cores made from continuous ferromagnetic material, and energized from one coil, as illustrated for magnets 20, 30, 60, 90, 400, and the like, may generate flux densities along the vertical surface of the molten metal sidewall that produce too much push-back at some portions of the sidewall. In accordance with another embodiment of this invention, this problem is solved by apparatus 800 which produces three parallel, adjustable flux paths.

Figure 49:
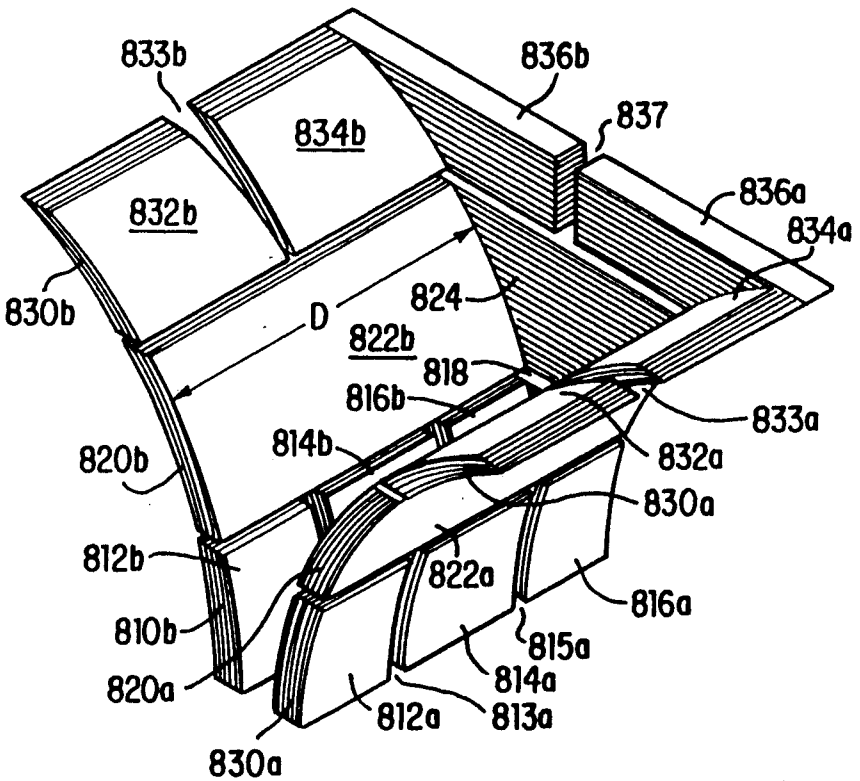
FIG. 49 is a perspective of the magnet core of the embodiment of FIGS. 47 and 48.
Figure 47:
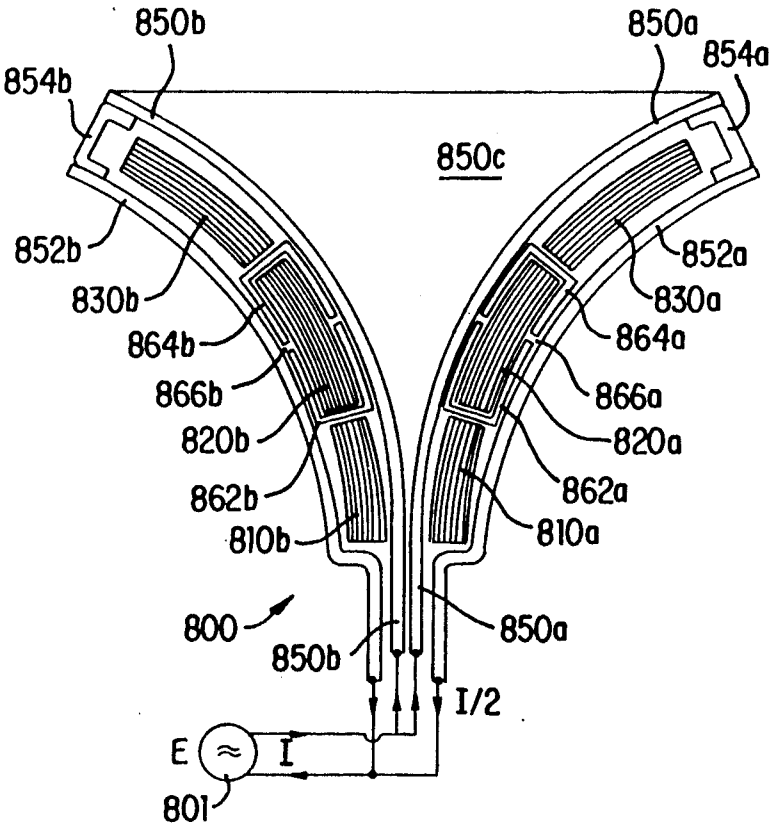
FIG. 47 is a front view of another embodiment of this invention having three isolated ferromagnetic core sections for optimizing electromagnetic sidewall containment.
Figure 48:
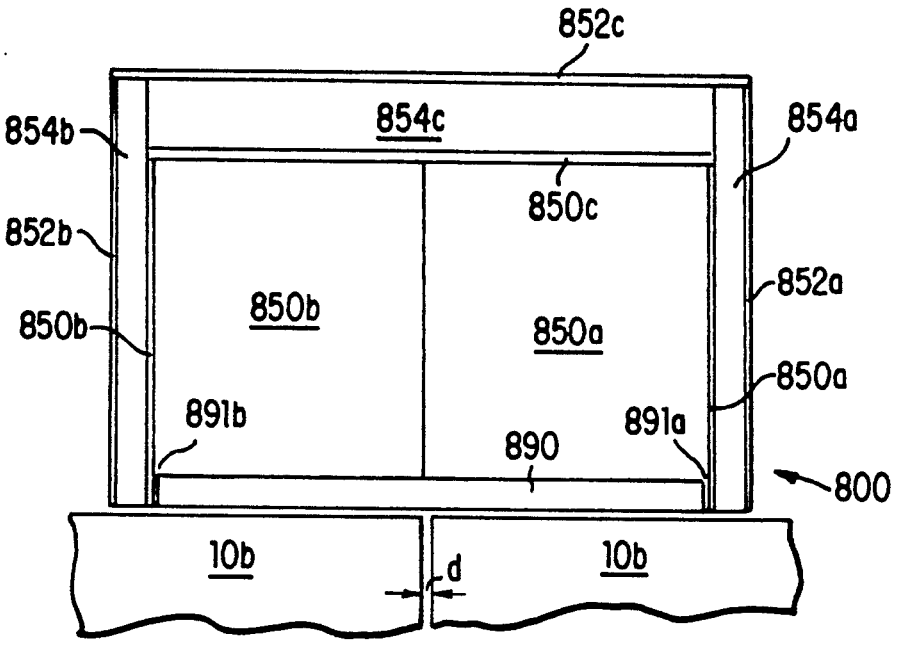
FIG. 48 is a top view of the apparatus of FIG. 47.

FIG. 47 is a front view and FIG. 48 a top view of magnet 800. FIG. 49 is a perspective of the magnet ferromagnetic core assembly which consists of three sections separated by horizontal air gaps. The bottom section consists of arced parts 812, 814, 816 and yoke 818; the mid section has arced parts 822 and yoke 824; and the top section has arced parts 832, 834 and yoke parts 836. Core faces 810, 820 and 830 represent the magnet poles disposed opposite rolls 10.

The core assembly is energized from a one-turn coil which encloses it except for the magnet poles 810, 820 and 830. The inner half of the coil consists of arced sheets 850*a* and 850*b* which are brazed to back plate 850*c*. The outer half of the coil consists of arced sheets 852*a* and 852*b* which are brazed to back plate 852*c*. These coil halves are joined by U-shaped channels 854*a*, 854*b* and 854*c*; for good electrical contact the joining surfaces are silver-plated and bolted together. The magnetic containment field is shaped with a solid, water cooled, copper piece 890 (FIG. 48) which is placed between the inner coil half 850, opposite to the rolls, and the molten-metal-sidewall of the casting apparatus. Piece 890 may be insulated from the coil or may be brazed to it, to reduce leakage flux. For sake of clarity, piece 890 is not shown in FIG. 47.

In order to isolate the magnetic fluxes of the three magnet core sections, the mid section 820 is enclosed by an electromagnetic shield, 860, made from copper. It consists of a lower U-shaped channel, 862, which encloses the lower half of core sections 822 and yoke 824, and an upper U-shaped channel, 864, which encloses the upper half of core sections 822 and yoke 824. Gaps 866 prevent the shields from being a shorted turn for the magnetic flux.

The magnetic pressure for containing the sidewall of a pool of molten metal is proportional to the square of the flux density of the containment field. The electromagnetic containment forces can be adjusted as a function of pool depth by adjusting the reluctance of the core flux paths as a function of pool depth. Magnet 800 accomplishes this by providing means to adjust the flux path reluctance for two of its three magnet core sections.

In the example illustrated by FIG. 49, the mid section of the magnet core requires more ampere-turns for sidewall containment than the top and bottom sections, and therefore, determines the magnet current. The reluctance of the mid section is made as small as practicable by keeping air gaps between parts 822 and 824 small. The push-back of the sidewall of the molten metal in the top and bottom sections is optimized by increasing the reluctance of the corresponding core sections with the addition of air gaps. As shown in FIG. 49, the reluctance of the bottom section of the magnet is increased by placing air gaps 813 and 815 into the flux path. The reluctance of the top section is increased with air gaps 833 and 837. The width of these air gaps may be constant or may change with vertical pool heights for further fine adjustment of flux distribution.

In FIG. 49, the horizontal gaps accommodate shield sections 862 and 864, and the vertical gaps are for reluctance control.

Figure 50A:
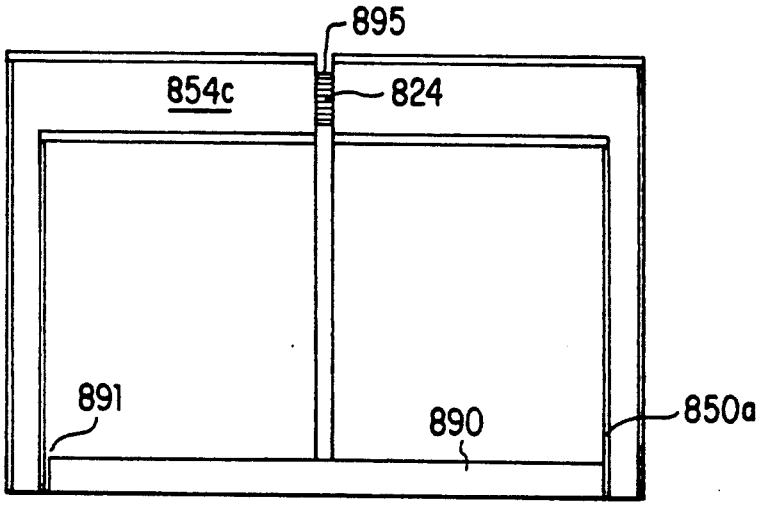
FIG. 50*a* is a top view of the apparatus of FIG. 47 having a two-turn excitation coil.
Figure 50B:
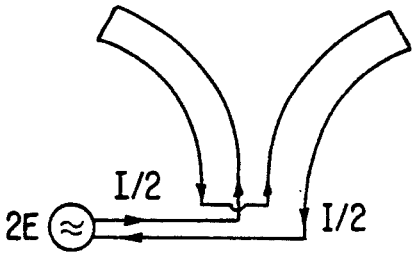
FIG. 50*b* shows the electrical connection for the two-turn coil depicted in FIG. 50*a*.

As illustrated by FIG. 50*a* the one-turn coil of magnet 800 can be converted into a two-turn coil by cutting a gap 895 along its center line where back plates 850*c*, 852*c* and connecting channel 854*c* are located. The core must be shielded at this location to reduce leakage flux. FIG. 50*b* is a schematic for two-turn operation. With a two-turn coil, the field shaping copper piece 890 may be insulated from the coil or may be connected to only one quarter of a turn (e.g., side 850*a*) as shown in FIG. 50*a*; air gap 891 isolates the two turns.

The embodiments of this invention for which an exclusive property or privilege is claimed are defined as follows:

What is claimed is:

1. A magnetic confining apparatus for preventing the escape of molten metal through an open side of a vertically extending gap between two horizontally spaced members and between which said molten metal is located, said apparatus comprising:

magnetic core means;

electrically conductive coil means operatively associated with said magnetic core means;

said magnetic core means comprising a pair of horizontally disposed, spaced, magnet poles disposed adjacent the open side of said gap for generating a mainly horizontal magnetic field which extends through the open side of said gap to said molten metal;

said magnet poles being sufficiently proximate to said open side of the gap so that said generated horizontal magnetic field has a strength sufficient to exert a confining pressure against the molten metal in the gap; and an inner, non-magnetic, electrically conductive shield means disposed between the magnet poles adjacent to the open side of the gap, and shaped to confine the horizontal magnetic field through the gap substantially to the molten metal.

2. An apparatus as recited in claim 1 further including:

an outer, non-magnetic, electrically conductive shield means disposed such that the magnetic core means and the coil means are sandwiched between said inner electrically conductive shield means and the outer electrically conductive shield means, for reducing leakage flux and for directing magnetic flux from said poles toward said molten metal.

3. An apparatus as recited in claim 2, wherein:

said open side of the gap lies in a vertical plane; and said inner shield means is disposed in substantially parallel relation to said open side of the gap.

4. An apparatus as recited in claim 2, wherein:

said magnet poles have upper portions and lower portions; and said inner shield means is larger than the open side of said vertically extending gap containing molten metal and spans substantially the entire vertical distance between the upper and lower portions of said magnet poles.

5. An apparatus as recited in claim 2, wherein said two horizontally spaced members each includes a beveled edge at said gap, and said inner shield means includes two beveled edges, each substantially parallel to one of the beveled edges on said horizontally spaced members.

6. An apparatus as recited in claim 2, wherein said outer shield means includes means for confining the magnetic core and the coil means between the inner shield and the outer shield while leaving the magnet poles exposed to the open side of the gap.

7. An apparatus as recited in claim 1, wherein said two horizontally disposed members are rotatable rolls having parallel axes and wherein:

said magnetic core is vertically disposed proximate to said open gap;

said coil means comprises a multiplicity of vertically disposed coil turns wrapped around said magnetic core; and said non-magnetic inner shield means comprises a conductive material having an inner surface adjacent to the open side of the gap and substantially parallel to the molten metal, said inner shield surface being disposed between said magnet poles and adjacent to said molten metal.

8. An apparatus as recited in claim 7, wherein the spaced magnet poles converge downwardly proximate to said open gap, and the width of said space narrows downwardly in conformity with a narrowing in the width of said open side of the gap.

9. An apparatus as recited in claim 7, wherein said inner shield means has a front surface adjacent to said open side of the gap, and a pair of downwardly substantially converging sidewalls which conform the shape of said inner shield means substantially to the shape of said open side of the gap.

10. An apparatus as recited in claim 7, wherein the space between horizontal members is equal to or smaller than the space between magnet poles.

11. An apparatus as recited in claim 7, wherein each horizontal member includes a surface-mounted, ferromagnetic, material disposed on major surfaces by conductive shields, such that a magnetic field generated in said ferromagnetic material will penetrate a sidewall of said horizontal members.

12. An apparatus as recited in claim 11, wherein the ferromagnetic material is selected from the group consisting of ferromagnetic disks, ferromagnetic toroids, ferromagnetic laminations, and combinations thereof.

13. An apparatus as recited in claim 1, wherein:

each of said spaced apart members has (a) a side edge defining an edge of said open side of the gap and (b) a side edge portion adjacent said side edge;

said inner shield means has (a) a pair of horizontally spaced outside edges and (b) an outside edge portion adjacent each side edge;

the horizontal distance between the two outside edges on said inner shield means is greater than the horizontal distance between said two side edges defining the open side of said gap, at the same vertical location along said gap;

each outside edge portion on said inner shield means is spaced away from a respective side edge portion of a member to define a narrow space therebetween; and said outside edge portion on the inner shield means and said side edge portion on the member comprise means cooperating to provide an increased magnetic flux density in the magnetic field in said narrow space, and in the magnetic field extending across said open side of the gap, as compared to the flux density obtained without these side edges, thereby preventing molten metal from flowing laterally outwardly through said narrow space.

14. An apparatus as recited in claim 13, wherein:

said inner shield means and at least said side edge portions of said members are composed of a metal having a high electrical conductivity.

15. An apparatus as recited in claim 14, wherein said molten metal is molten steel and said coil means and said inner shield means are each composed of a metal selected from the group consisting of copper, aluminum, silver and alloys containing one or more of said metals.

16. An apparatus as recited in claim 13, wherein the inner shield means has a shape conforming substantially to the shape of the open side of said gap.

17. An apparatus as recited in claim 13, comprising means, including the configuration of said magnet poles, for increasing the magnetic pressure associated with said magnetic field in conformity with increasing static pressure of the molten metal in said gap.

18. An apparatus as recited in claim 13, wherein a surface of each of said magnet poles is perpendicular to one of the axes of the horizontally spaced members.

19. An apparatus as recited in claim 13, wherein a surface of each of said magnet poles is at an angle with respect to one of the axes of the horizontally spaced members.

20. An apparatus as recited in claim 2, wherein an edge surface of said horizontally spaced members and said magnet pole surfaces are at an angle with respect to the axes of the horizontally spaced members; said angled horizontal member edge and pole surfaces being disposed parallel to and spaced from each other.

21. An apparatus as recited in claim 20, wherein the magnet poles and inner shield means extend into said open end of the gap in close proximity to the horizontal members.

22. An apparatus as recited in claim 21, wherein the horizontal members include cut-out edges widening toward to the magnetic core, and wherein the magnet poles extend into said open end of the gap within the cut-out edges.

23. An apparatus as recited in claim 20, wherein the magnetic core and magnet poles are formed from laminations of ferromagnetic material.

24. An apparatus as recited in claim 1, wherein:

each magnet pole has a pole surface disposed perpendicular to a longitudinal axis of one of the horizontal members;

the core and poles are enclosed by conductive material, including said inner shield means, except for a horizontal separation, said separation preventing the conductive material from becoming a shorted turn around the core;

said conductive material comprising means for confining magnetic flux emanating from the magnet poles and for shaping the magnetic field between the pole surfaces;

said coil means disposed to encircle said conductive material and said conductive material disposed to enclose said core and said coil means being responsive to an alternating current source; and said conductive material and said side of the horizontal members parallel to said open side of the gap comprising means cooperating to shape an alternating magnetic field generated between said poles so that said molten metal is confined between the horizontal members.

25. The apparatus of claim 24, wherein said pole surfaces and a surface of the conductive material adjacent said open side of the gap are perpendicular to the axes of the horizontal members.

26. The apparatus of claim 24, wherein the inner conductive shield means disposed between said pole surfaces comprises means protruding further outwardly toward said molten metal than do said pole surfaces, for shaping the magnetic field between the pole surfaces and the molten metal sidewall.

27. An apparatus as recited in claim 24, wherein each horizontal member has a sidewall adjacent said gap and said apparatus includes a plurality of magnetic core means for collecting and compressing magnetic flux in said sidewalls of the horizontal members, to contain deep pools of molten metal therebetween;

and, wherein each of the plurality of magnetic core means is enclosed by an electromagnetic shield to confine the magnetic flux to the sides of the ferromagnetic cores.

28. An apparatus as recited in claim 27, wherein the containment flux density resulting from the collection and compression of magnetic flux in said sidewalls is greater than a saturation flux density of the magnet poles.

29. An apparatus as recited in claim 27, wherein the magnet poles and inner shield means have surfaces adjacent and essentially parallel to said sidewalls of the horizontal members and the molten metal in said open side of the gap.

30. An apparatus as recited in claim 29, wherein the inner shield means includes a surface adjacent to said open side of the gap that protrudes further outwardly toward said gap than do said pole surfaces.

31. An apparatus as recited in claim 27, wherein a magnetic core means disposed relatively close to the inner shield means provides a flux density at the magnet poles that is greater than the flux density provided by a magnetic core means disposed further away from the inner shield means.

32. An apparatus as recited in claim 27, wherein each magnetic core means includes a generally triangular-shaped cut-out portion comprising means for providing a flux density across each magnet pole that is essentially constant.

33. An apparatus as recited in claim 32, wherein the cut-out portions in each magnetic core means are sized to provide identical magnetic field from each magnet pole surface.

34. An apparatus as recited in claim 1, wherein the magnet poles and a portion of the magnetic core means are fabricated from tape-wound, curved cylinders cut into sections and disposed in alignment.

35. A magnetic confining apparatus for preventing the escape of molten metal through the open side of a vertically extending gap between two horizontally spaced rollers, between which said molten metal is located, said apparatus comprising:

roller mounted, annular-shaped ferromagnetic material disposed adjacent to the open side of said gap;

a stationary magnet, having a pair of magnetic poles for generating, at a location proximate to sa annular-shaped roller mounted ferromagnetic material, an alternating horizontal magnetic field which extends through the annular-shaped material to the open side of said gap to said molten metal;

a shaped inner, electrically conductive shield disposed between the magnet poles and adjacent to said gap to confine said magnetic field to said open side of said gap and to provide said horizontal magnetic field with a strength sufficient to exert a confining electromagnetic pressure against the molten metal in said gap.

36. An apparatus as recited in claim 35, wherein said roller-mounted, annular material comprises thin, insulated, ferromagnetic disks.

37. An apparatus as cited in claim 35, wherein said roller-mounted, annular ferromagnetic material is in a shape of a toroid.

38. An apparatus as recited in claim 35, wherein said toroids are mounted to said rollers by means of copper cylinders to reduce leakage fields.

39. An apparatus as recited in claim 35, wherein said roller-mounted, annular material comprises a plurality of ferromagnetic toroids, said toroids being contained and shielded on their surfaces by copper cylinders.

40. An apparatus as recited in claim 39, wherein the surfaces of the toroids and the surfaces of the magnet poles of said stationary magnet are parallel to the axes of the horizontally spaced rollers.

41. An apparatus as recited in claim 39, wherein the surfaces of the toroids and the magnet poles are at an angle with respect to the axes of the rollers.

42. An apparatus as recited in claim 35, wherein the roller-mounted, annular material comprises a plurality of ferromagnetic laminations oriented horizontally, said laminations being insulated from each other and providing a low reluctance path for flux in a radial direction, and a high reluctance path in an azimuthal direction for confining the magnetic field generated by said stationary magnet to said open side of said gap between said rollers.

43. An apparatus as recited in claim 42, wherein said laminations taper from adjacent said stationary magnet to the roller edge to increase the flux density at the roller edge.

44. An apparatus as recited in claim 43, wherein said ferromagnetic laminations are in contact with the roller edge.

45. An apparatus as recited in claim 43, wherein said ferromagnetic laminations are set back from the rollers edge thereby causing some magnetic flux to penetrate said roller edge.

46. An apparatus as recited in claim 42, wherein said laminations taper and are shaped to be partially in contact with the roller edge thereby causing a substantial portion of the magnetic flux to penetrate the roller near its edge.

47. A magnetic confining apparatus for preventing the escape of molten metal through the open side of a vertically extending gap between two horizontally spaced members, between which said molten metal is located, said apparatus comprising:

magnetic core means, having a pair of spaced, cooperating magnet poles adjacent to the open side of said gap;

electrically conductive coil means operatively associated with said magnetic core means for generating a horizontal magnetic field which extends through the open side of said gap to said molten metal from said pair of spaced magnet poles;

a shaped inner non-magnetic conductor shield disposed between the magnet poles and adjacent to said gap to confine said magnetic field to said open side of said gap, and thereby generating said horizontal magnetic field with strength sufficient to exert a confining pressure against the molten metal in said gap.

48. An apparatus as recited in claim 47, wherein the magnet core and poles are enclosed by a single-turn coil, said coil being formed from high conductivity metal.

49. An apparatus as recited in claim 48, wherein a portion of the single-turn conductive coil is disposed adjacent to said molten metal and wherein said coil has a shape adapted to shape the magnetic field between the magnet-pole surfaces and the molten metal pool.

50. An apparatus as recited in claim 48, wherein each coil terminal has slots adapted to provide a more uniform-current distribution through the coil.

51. An apparatus as recited in claim 48, wherein the coil is fabricated predominantly from high conductivity metal sheets having a thickness which is, less than 4 times the skin depth of the conductor at the magnet operating frequency.

52. An apparatus as recited in claim 47, wherein the magnet and poles are enclosed by a plurality of nested, single-turn coil assemblies, said assemblies being coaxially arranged and electrically energized in parallel or in series connection.

53. An apparatus as recited in claim 52, wherein the conductor adjacent said molten metal is shaped to provide a shaped magnetic field between the magnet-pole surfaces and the molten metal sidewalls.

54. An apparatus as recited in claim 52, wherein the coil is fabricated predominantly from high conductivity metal sheets having a thickness which is less than 4 times the skin depth of the conductor at the magnet operating frequency.

55. An apparatus as recited in claim 47, wherein the ferromagnetic magnet core and poles are arranged as multiple sections operating in parallel and energized from one coil common to all sections for optimizing containment of said molten metal.

56. An apparatus as recited in claim 55, wherein the flux paths of the multiple core and pole sections, operating in parallel, are magnetically isolated from each other by means of electromagnetic shields.

57. An apparatus as recited in claim 56, wherein vertical air gaps are provided in all but one of the multiple core and pole sections to provide independent reluctance control for each of the core and pole sections operating in parallel.

58. An apparatus as recited in claim 57, wherein the reluctance of all but one of the multiple parallel core and pole sections is capable of adjustment by changing the width of the vertical air gaps, thereby optimizing containment of said molten metal.

59. A magnetic confining method for preventing the escape of molten metal through the open side of a vertically extending gap between two horizontally spaced members and between which said molten metal is located, said method comprising the steps of:

disposing a pair of spaced, cooperating magnet poles adjacent to the open side of said gap;

generating, at a location adjacent the open side of said gap, a horizontal magnetic field which extends through the open side of said gap to said molten metal from said pair of spaced magnet poles;

generating said horizontal magnetic field sufficiently proximate to said open side of the gap so that said horizontal magnetic field has a strength sufficient to exert a confining pressure against the molten metal in said gap; and confining said magnetic field to said open side of the gap by disposing a shaped inner non-magnetic conductor between the magnet poles and adjacent to said gap.

60. A method as recited in claim 59, wherein said generating step comprises:

providing electrically-conductive coil means surrounding a magnetic core means adjacent to the open side of said gap and having said magnet poles disposed sufficiently close to the molten metal for molten metal confinement; and conducting electric current through said coil to generate said horizontal magnetic field.

61. A method as recited in claim 60 and comprising providing a low reluctance return path, composed of magnetic material, for said generated magnetic field which extends through said open side of the gap.

62. A method as recited in claim 61 and comprising confining that part of said magnetic field which is outside of said low reluctance return path to substantially a space defined on one side by said shaped inner conductor and on the other side by said molten metal.

63. A method as recited in claim 62 and comprising increasing the magnetic pressure associated with said magnetic field in conformity with increasing static and dynamic pressure of the molten metal in said gap.

64. A magnetic confining method for preventing the escape of molten metal through an open side of a vertically extending gap between two horizontally spaced non-magnetic conductive members and between which said molten metal is located, said method comprising the steps of:

disposing a pair of spaced, cooperating magnet poles adjacent to the open side of the gap and set back from non-magnetic edges of the horizontally spaced conductive members and having a wider spacing than the spacing of the edges of the conductive members, and generating, at a location adjacent the open side of said gap, a magnetic field that is larger than required for sidewall containment of the molten metal while limiting the amount of push back of the molten metal by the magnetic flux shielding effect of the conductive members, and disposing an inner, non-magnetic, electrically conductive shield means between the magnetic poles adjacent to the open side of the gap.

65. A method as recited in claim 64, wherein the magnetic field generated is up to 100 times that required for sidewall containment of the molten metal if the flux shielding effect of the conductive members did not exist.

* * * * *

UNITED STATES PATENT AND TRADEMARK OFFICE

CERTIFICATE OF CORRECTION

PATENT NO. : 5,251,685

DATED : OCTOBER 12, 1993

INVENTOR : WALTER F. PRAEG

It is certified that error appears in the above-identified patent and that said Letters Patent is hereby corrected as shown below:

Column 4, line 51, after "line" delete "713 7" and substitute therefor -- 7-7 --;

Column 6, line 15, after "for" delete "two turn" and substitute therefor -- two-turn --;

Column 21, line 20, after "to" delete "sa" and substitute therefor -- said --; and Column 22, lines 41-42, after "more" delete "uniform-current" and substitute therefor -- uniform current --.

Signed and Sealed this

Twenty-sixth Day of July, 1994

*Attest:*

Bruce Lehman

BRUCE LEHMAN

*Attesting Officer*

*Commissioner of Patents and Trademarks*